US010984741B2

(12) United States Patent
Park et al.

(10) Patent No.: US 10,984,741 B2
(45) Date of Patent: Apr. 20, 2021

(54) DISPLAY APPARATUS AND METHOD OF DRIVING THE SAME

(71) Applicant: SAMSUNG DISPLAY CO., LTD., Yongin-si (KR)

(72) Inventors: Juki Park, Anseong-si (KR); Tae-Jong Jun, Suwon-si (KR); Jinseob Byun, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 102 days.

(21) Appl. No.: 15/948,327

(22) Filed: Apr. 9, 2018

(65) Prior Publication Data

US 2019/0012972 A1 Jan. 10, 2019

(30) Foreign Application Priority Data

Jul. 7, 2017 (KR) ..... 10-2017-0086337

(51) Int. Cl.
*G09G 3/36* (2006.01)

(52) U.S. Cl.
CPC ..... *G09G 3/3614* (2013.01); *G09G 3/3611* (2013.01); *G09G 3/3677* (2013.01);
(Continued)

(58) Field of Classification Search
CPC .. G09G 3/3611; G09G 3/3614; G09G 3/3677; G09G 3/3688; G09G 3/3696;
(Continued)

(56) References Cited

U.S. PATENT DOCUMENTS

2001/0043178 A1* 11/2001 Okuzono ..... G09G 3/3648 345/87
2005/0259067 A1* 11/2005 Cheng ..... G09G 3/3614 345/103

(Continued)

FOREIGN PATENT DOCUMENTS

KR 1020130134567 12/2013
KR 1020140003146 1/2014
KR 10-1578218 12/2015

*Primary Examiner* — Mihir K Rayan
(74) *Attorney, Agent, or Firm* — F. Chau & Associates, LLC

(57) ABSTRACT

A display apparatus includes a display panel, a gate driving circuit, and a data driving circuit. The display panel includes N gate lines, M data lines, and a plurality of pixels connected to the N gate lines and the M data lines. The gate driving circuit sequentially drives K-th, (K+2)-th, (K+4)-th, (K+12)-th, (K+14)-th, (K+16)-th, (K+24)-th, . . . , (N−11)-th, (N−9)-th, and (N−7)-th gate lines during a first subframe period, (K+6)-th, (K+8)-th, (K+10)-th, (K+18)-th, (K+20)-th, (K+22)-th, (K+30)-th, . . . , (N−5)-th, (N−3)-th, and (N−1)-th gate lines during a second subframe period, (K+1)-th, (K+3)-th, (K+5)-th, (K+13)-th, (K+15)-th, (K+17)-th, (K+25)-th, . . . , (N−10)-th, (N−8)-th, and (N−6)-th gate lines during a third subframe period, and (K+7)-th, (K+9)-th, (K+11)-th, (K+19)-th, (K+21)-th, (K+23)-th, (K+31)-th, . . . , (N−4)-th, (N−2)-th, and N-th gate lines during a fourth subframe period. The data driving circuit drives the M data lines by outputting data signals to the M data lines.

19 Claims, 33 Drawing Sheets

(52) U.S. Cl.
CPC ..... *G09G 3/3688* (2013.01); *G09G 3/3696* (2013.01); *G09G 2300/0426* (2013.01); *G09G 2300/0452* (2013.01); *G09G 2310/0213* (2013.01); *G09G 2320/028* (2013.01); *G09G 2320/068* (2013.01)

(58) Field of Classification Search
CPC . G09G 2300/0426; G09G 2300/04512; G09G 2310/0213; G09G 2320/028; G09G 2320/068
See application file for complete search history.

(56) References Cited

U.S. PATENT DOCUMENTS

| | | | | |
|---|---|---|---|---|
| 2007/0069214 | A1* | 3/2007 | Lee | G09G 3/3648 257/72 |
| 2008/0088559 | A1* | 4/2008 | Lai | G09G 3/3648 345/89 |
| 2009/0179875 | A1* | 7/2009 | Li | G09G 3/3648 345/204 |
| 2012/0105752 | A1* | 5/2012 | Park | G09G 3/3648 349/33 |
| 2017/0278444 | A1* | 9/2017 | Tien | G09G 3/2003 |

* cited by examiner

DISPLAY APPARATUS AND METHOD OF DRIVING THE SAME

CROSS-REFERENCE TO RELATED APPLICATION

This application claims priority under 35 U.S.C. § 119 to Korean Patent Application No. 10-2017-0086337, filed on Jul. 7, 2017 in the Korean Intellectual Property Office (KIPO), the disclosure of which is incorporated by reference herein in its entirety.

TECHNICAL FIELD

Exemplary embodiments of the inventive concept relate generally to displaying images, and more particularly, to display apparatuses and methods of driving the display apparatuses.

DISCUSSION OF RELATED ART

A liquid crystal display (LCD) apparatus includes an LCD panel and a display panel driving circuit.

The LCD panel includes a gate line, a data line, and a pixel that is connected to the gate line and the data line. The pixel includes a thin film transistor, a liquid crystal capacitor, and a storage capacitor. The thin film transistor is electrically connected to the gate line and the data line. The liquid crystal capacitor is electrically connected to the thin film transistor and is formed by a pixel electrode and a common electrode. The storage capacitor is electrically connected to the thin film transistor.

The display panel driving circuit includes a gate driving circuit and a data driving circuit. The gate driving circuit outputs a gate signal to the gate line. The data driving circuit outputs a data signal to the data line to charge a data voltage to the pixel electrode.

Generally, an LCD apparatus has a visibility from the side that is lower than a visibility from the front. In addition, if a data signal having only one polarity (e.g., a positive or negative polarity) has been applied to the pixel, liquid crystal included in the LCD apparatus is degraded, and thus a display quality of the LCD apparatus is degraded.

SUMMARY

According to an exemplary embodiment of the inventive concept, a display apparatus includes a display panel, a gate driving circuit, and a data driving circuit. The display panel displays an image, and includes N gate lines extending in a first direction, M data lines extending in a second direction substantially perpendicular to the first direction, and a plurality of pixels each of which is connected to a respective one of the N gate lines and a respective one of the M data lines. N is a natural number greater than or equal to 48 and M is a natural number greater than or equal to 4. The gate driving circuit sequentially drives K-th, (K+2)-th, (K+4)-th, (K+12)-th, (K+14)-th, (K+16)-th, (K+24)-th, . . . , (N−11)-th, (N−9)-th, and (N−7)-th gate lines during a first subframe period, sequentially drives (K+6)-th, (K+8)-th, (K+10)-th, (K+18)-th, (K+20)-th, (K+22)-th, (K+30)-th, . . . , (N−5)-th, (N−3)-th, and (N−1)-th gate lines during a second subframe period subsequent to the first subframe period, sequentially drives (K+1)-th, (K+3)-th, (K+5)-th, (K+13)-th, (K+15)-th, (K+17)-th, (K+25)-th, . . . , (N−10)-th, (N−8)-th, and (N−6)-th gate lines during a third subframe period subsequent to the second subframe period, and sequentially drives K+7)-th, (K+9)-th, (K+11)-th, (K+19)-th, (K+21)-th, (K+23)-th, (K+31)-th, . . . , (N−4)-th, (N−2)-th, and N-th gate lines during a fourth subframe period subsequent to the third subframe period. K is a natural number less than N. The data driving circuit drives the M data lines by outputting a plurality of data signals to the M data lines.

In an exemplary embodiment of the inventive concept, each of the M data lines may include a first side and a second side along the second direction. Each of the M data lines may be connected to some of the plurality of pixels alternately at the first side and the second side.

In an exemplary embodiment of the inventive concept, the data driving circuit may output first data signals having a first polarity during the first subframe period, output second data signals having a second polarity opposite to the first polarity during the second subframe period, output third data signals having the first polarity during the third subframe period, and output fourth data signals having the second polarity during the fourth subframe period.

In an exemplary embodiment of the inventive concept, the plurality of data signals may be reversed in polarity for every two data lines in the first direction.

In an exemplary embodiment of the inventive concept, each of the plurality of data signals may be generated using one of a high gamma voltage and a low gamma voltage. The plurality of pixels may have a gamma pattern in which a high gamma data voltage based on the high gamma voltage and a low gamma data voltage based on the low gamma voltage are alternately arranged for every row and column in the first and second directions.

In an exemplary embodiment of the inventive concept, each of the M data lines may include a first side along the second direction. Each of the M data lines may be connected to some of the plurality of pixels at the first side.

In an exemplary embodiment of the inventive concept, the data driving circuit may output first data signals having a first polarity during the first subframe period, output second data signals having a second polarity opposite to the first polarity during the second subframe period, output third data signals having the first polarity during the third subframe period, and output fourth data signals having the second polarity during the fourth subframe period.

In an exemplary embodiment of the inventive concept, the plurality of data signals may be reversed in polarity for every two data lines in the first direction.

In an exemplary embodiment of the inventive concept, each of the plurality of data signals may be generated using one of a high gamma voltage and a low gamma voltage. The plurality of pixels may have a gamma pattern in which a high gamma data voltage based on the high gamma voltage and a low gamma data voltage based on the low gamma voltage are alternately arranged for every row and column in the first and second directions.

In an exemplary embodiment of the inventive concept, each of the M data lines may include a first side and a second side along the second direction. Each of the M data lines may be connected to some of the plurality of pixels, alternately for every three pixels, at the first side and the second side.

In an exemplary embodiment of the inventive concept, the data driving circuit may output first data signals having a first polarity during the first subframe period, output second data signals having a second polarity opposite to the first polarity during the second subframe period, output third data signals having the first polarity during the third subframe period, and output fourth data signals having the second polarity during the fourth subframe period.

In an exemplary embodiment of the inventive concept, the plurality of data signals may be reversed in polarity for every two data lines in the first direction.

In an exemplary embodiment of the inventive concept, each of the plurality of data signals may be generated using one of a high gamma voltage and a low gamma voltage. The plurality of pixels may have a gamma pattern in which a high gamma data voltage based on the high gamma voltage and a low gamma data voltage based on the low gamma voltage are alternately arranged for every row and column in the first and second directions.

In an exemplary embodiment of the inventive concept, each of the plurality of pixels may include a plurality of first color pixels, a plurality of second color pixels and a plurality of third color pixels. The plurality of first color pixels may be arranged in the first direction. The plurality of second color pixels may be arranged in the first direction at a first side with respect to the plurality of first color pixels. The plurality of third color pixels may be arranged in the first direction at the first side with respect to the plurality of second color pixels.

In an exemplary embodiment of the inventive concept, the plurality of first color pixels may include blue pixels, the plurality of second color pixels may include green pixels, and the plurality of third color pixels may include red pixels.

In an exemplary embodiment of the inventive concept, the plurality of pixels may be reversed in polarity for every two pixels in the first direction and for every six pixels in the second direction.

According to an exemplary embodiment of the inventive concept, in a method of driving a display apparatus, the display apparatus displays an image and includes N gate lines extending in a first direction, M data lines extending in a second direction substantially perpendicular to the first direction, and a plurality of pixels each of which is connected to a respective one of the N gate lines and a respective one of the M data lines. N is a natural number greater than or equal to 48 and M is a natural number greater than or equal to 4. K-th, (K+2)-th, (K+4)-th, (K+12)-th, (K+14)-th, (K+16)-th, (K+24)-th, . . . , (N−11)-th, (N−9)-th, and (N−7)-th gate lines are sequentially driven during a first subframe period, (K+6)-th, (K+8)-th, (K+10)-th, (K+18)-th, (K+20)-th, (K+22)-th, (K+30)-th, . . . , (N−5)-th, (N−3)-th, and (N−1)-th gate lines are sequentially driven during a second subframe period subsequent to the first subframe period, (K+1)-th, (K+3)-th, (K+5)-th, (K+13)-th, (K+15)-th, (K+17)-th, (K+25)-th, . . . , (N−10)-th, (N−8)-th, and (N−6)-th gate lines are sequentially driven during a third subframe period subsequent to the second subframe period, and (K+7)-th, (K+9)-th, (K+11)-th, (K+19)-th, (K+21)-th, (K+23)-th, (K+31)-th, . . . , (N−4)-th, (N−2)-th, and N-th gate lines are sequentially driven during a fourth subframe period subsequent to the third subframe period. K is a natural number less than N. The M data lines are driven by outputting a plurality of data signals to the M data lines.

In an exemplary embodiment of the inventive concept, in driving the M data lines, first data signals having a first polarity may be output during the first subframe period. Second data signals having a second polarity opposite to the first polarity may be output during the second subframe period. Third data signals having the first polarity may be output during the third subframe period. Fourth data signals having the second polarity may be output during the fourth subframe period.

In an exemplary embodiment of the inventive concept, the plurality of data signals may be reversed in polarity for every two data lines in the first direction.

In an exemplary embodiment of the inventive concept, each of the plurality of data signals may be generated using one of a high gamma voltage and a low gamma voltage. The plurality of pixels may have a gamma pattern in which a high gamma data voltage based on the high gamma voltage and a low gamma data voltage based on the low gamma voltage are alternately arranged for every row and column in the first and second directions.

According to an exemplary embodiment of the inventive concept, a display apparatus may include a display panel, a gate driving circuit, a data driving circuit, and a gamma voltage generating circuit. The display panel may be configured to display an image, and include a plurality of gate lines extending in a first direction, a plurality of data lines extending in a second direction substantially perpendicular to the first direction, and a plurality of pixels each of which is connected to a respective one of the plurality of gate lines and a respective one of the plurality of data lines. The gate driving circuit may be configured to drive the plurality of gate lines. The data driving circuit may be configured to drive the plurality of data lines by outputting a plurality of data signals to the plurality of data lines. The gamma voltage generating circuit may be configured to generate a first gamma voltage and a second gamma voltage that is lower than the first gamma voltage. The plurality of pixels may have a gamma pattern in which a first gamma data voltage based on the first gamma voltage and a second gamma data voltage based on the second gamma voltage are alternately arranged for every row and column in the first and second directions. Polarities of pixels in each row of the plurality of pixels may alternate according to a first pattern. Polarities of pixels in each column of the plurality of pixels may alternate according to a second pattern.

BRIEF DESCRIPTION OF THE DRAWINGS

The above and other features of the inventive concept will be more clearly understood by describing in detail exemplary embodiments thereof with reference to the accompanying drawings.

DETAILED DESCRIPTION OF THE EMBODIMENTS

Figure 1:
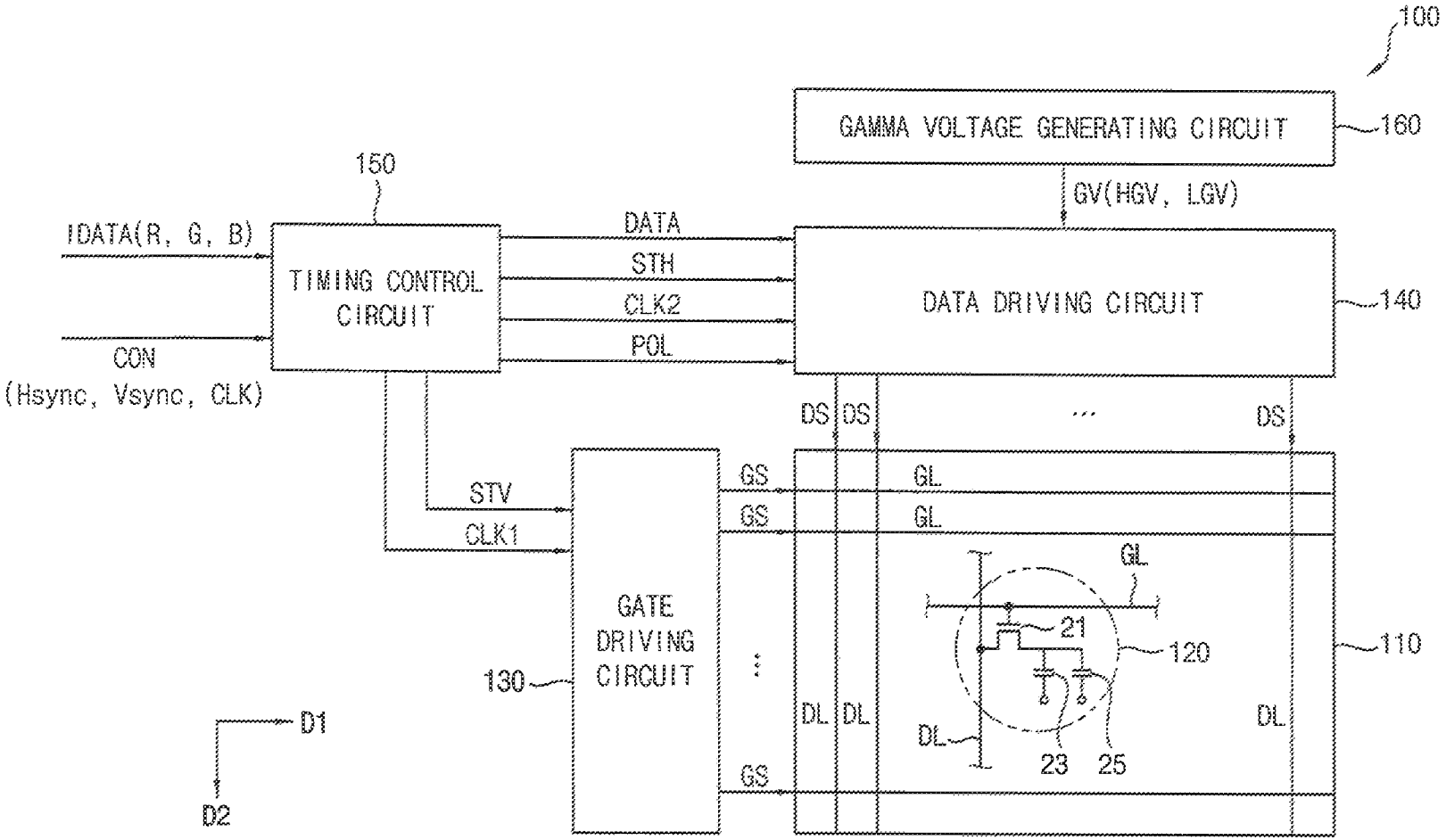
FIG. 1 is a block diagram illustrating a display apparatus according to an exemplary embodiment of the inventive concept.

Exemplary embodiments of the inventive concept provide a display apparatus capable of increasing display quality.

Exemplary embodiments of the inventive concept provide a method of driving the display apparatus.

Exemplary embodiments of the inventive concept will be described more fully hereinafter with reference to the accompanying drawings. Like reference numerals may refer to like elements throughout this application.

FIG. 1 is a block diagram illustrating a display apparatus according to an exemplary embodiment of the inventive concept.

Referring to FIG. 1, a display apparatus 100 includes a display panel 110, a gate driving circuit 130, a data driving circuit 140, a timing control circuit 150, and a gamma voltage generating circuit 160.

The display panel 110 receives a plurality of data signals DS from the data driving circuit 140 to display an image. The display panel 110 includes a plurality of gate lines GL, a plurality of data lines DL, and a plurality of pixels 120. Each of the plurality of gate lines GL extends in a first direction D1, and the plurality of gate lines GL are arranged along a second direction D2 that is substantially perpendicular to the first direction D1. Each of the plurality of data lines DL extends in the second direction D2, and the plurality of data lines DL are arranged along the first direction D1. For example, the first direction D1 may be substantially in parallel with a relatively long side of the display panel 110, and the second direction D2 may be substantially in parallel with a relatively short side of the display panel 110.

Each of the plurality of pixels 120 is connected to a respective one of the plurality of gate lines GL and a respective one of the plurality of data lines DL. Each of the plurality of pixels 120 includes a thin film transistor 21, a liquid crystal capacitor 23, and a storage capacitor 25. The thin film transistor 21 is electrically connected to the respective one of the plurality of gate lines GL and the respective one of the plurality of data lines DL. The liquid crystal capacitor 23 and the storage capacitor 25 are connected to the thin film transistor 21. For example, the display panel 110 may be a liquid crystal display (LCD) panel.

The gate driving circuit 130, the data driving circuit 140, the timing control circuit 150, and the gamma voltage generating circuit 160 may be referred to as a display panel driving circuit for driving the display panel 110.

The gate driving circuit 130 generates a plurality of gate signals GS in response to a vertical start signal STV and a first clock signal CLK1 that are provided from the timing control circuit 150, and outputs the plurality of gate signals GS to the plurality of gate lines GL. For example, the gate driving circuit 130 may include one or more gate drivers.

The data driving circuit 140 receives image data DATA from the timing control circuit 150, generates the plurality of data signals DS based on the image data DATA, and outputs the plurality of data signals DS to the plurality of data lines DL in response to a horizontal start signal STH and a second clock signal CLK2 that are provided from the timing control circuit 150. In addition, the data driving circuit 140 may generate the plurality of data signals DS based on a gamma voltage GV that is provided from the gamma voltage generating circuit 160, and may control polarities of the plurality of data signals DS based on a polarity control signal POL that is provided from the timing control circuit 150. For example, the data driving circuit 140 may include one or more data drivers.

The timing control circuit 150 receives input image data IDATA and a control signal CON from an external device (e.g., a host or a graphic processor). For example, the input image data IDATA may include red data R, green data G, and blue data B. The control signal CON may include a horizontal synchronization signal Hsync, a vertical synchronization signal Vsync, and a clock signal CLK. The timing control circuit 150 generates the image data DATA based on the input image data IDATA, generates the horizontal start signal STH based on the horizontal synchronization signal Hsync, generates the vertical start signal STV based on the vertical synchronization signal Vsync, generates the first and second clock signals CLK1 and CLK2 based on the clock signal CLK, and generates the polarity control signal POL for controlling the polarities of the plurality of data signals DS. The timing control circuit 150 outputs the vertical start signal STV and the first clock signal CLK1 to the gate driving circuit 130, and outputs the image data DATA, the horizontal start signal STH, the second clock signal CLK2, and the polarity control signal POL to the data driving circuit 140. For example, the timing control circuit 150 may include a timing controller.

The gamma voltage generating circuit 160 generates and outputs the gamma voltage GV to the data driving circuit 140. The gamma voltage GV may include a high gamma voltage HGV and a low gamma voltage LGV. For example, the gamma voltage generating circuit 160 may include a gamma voltage generator.

Figure 2A:
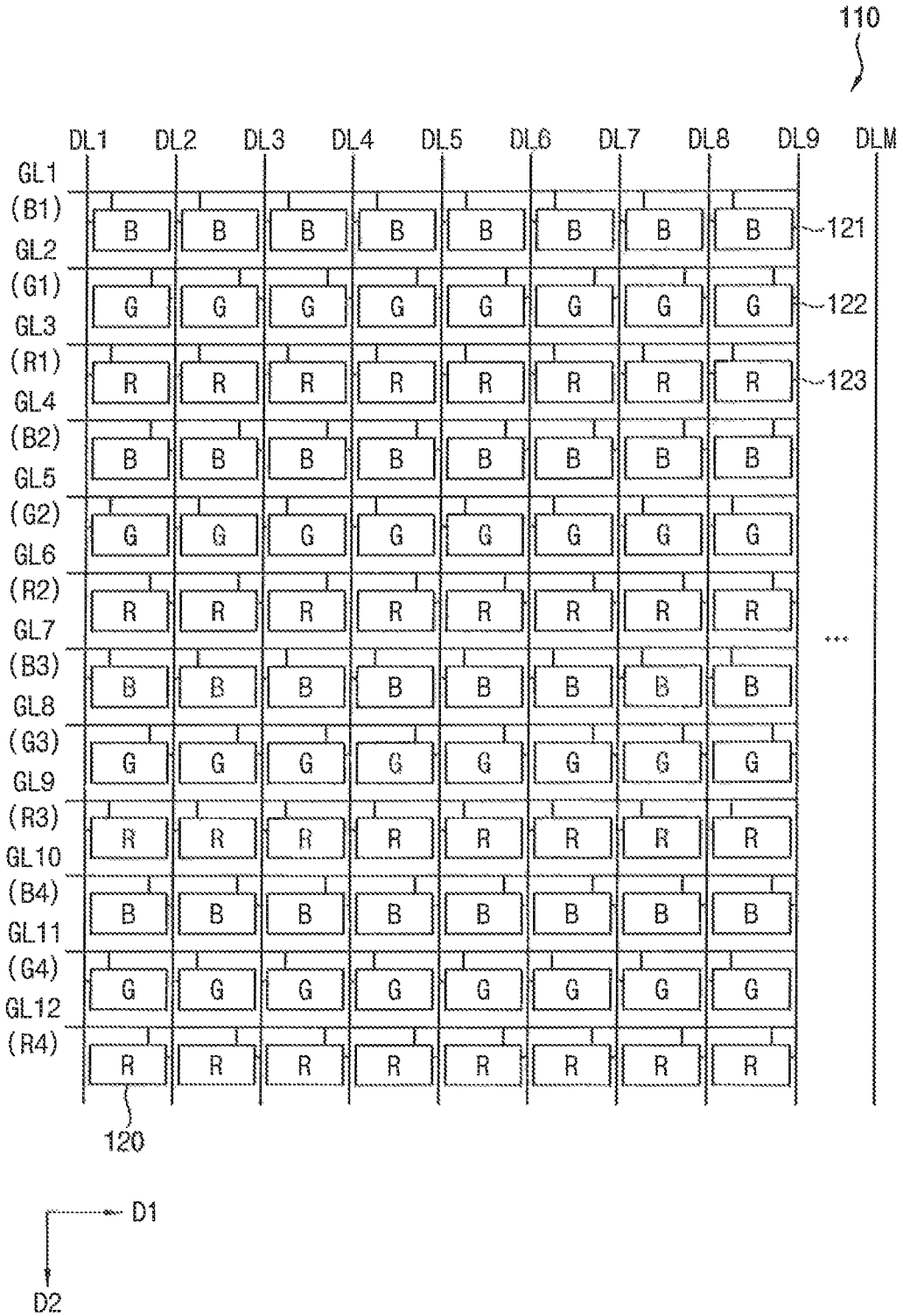
FIGS. 2A and 2B are plan views illustrating a display panel included in the display apparatus of FIG. 1 according to an exemplary embodiment of the inventive concept.
Figure 2B:
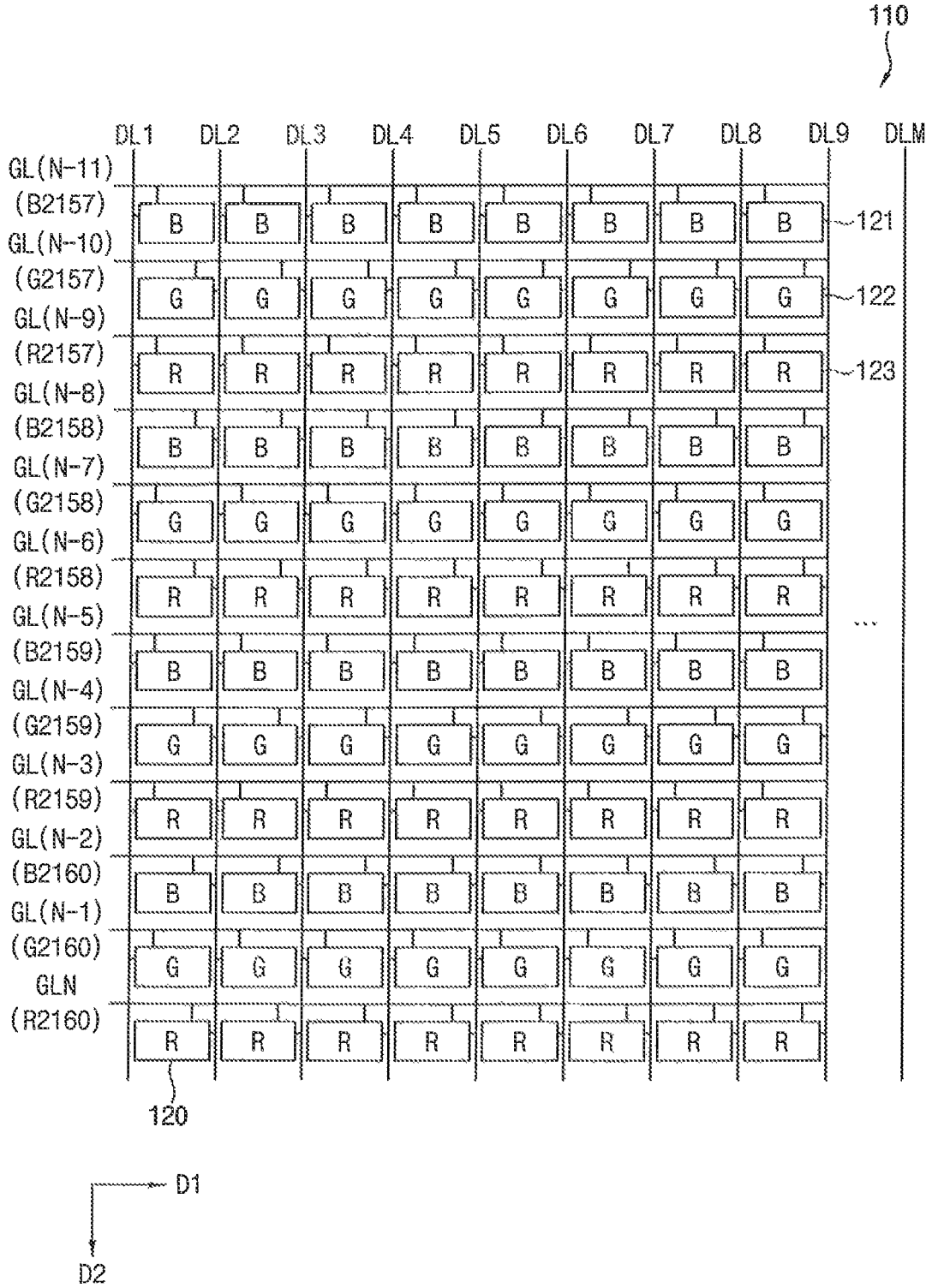

FIGS. 2A and 2B are plan views illustrating a display panel included in the display apparatus of FIG. 1 according to an exemplary embodiment of the inventive concept.

Referring to FIGS. 1, 2A, and 2B, the display panel 110 includes first through N-th gate lines GL1, GL2, . . . , GLN and first through M-th data lines DL1, DL2, . . . , DLM, where N is a natural number greater than or equal to 48 and M is a natural number greater than or equal to 4. The display panel 110 includes the plurality of pixels 120, each of which is connected to a respective one of the first through N-th gate lines GL1, GL2, . . . , GLN and a respective one of the first through M-th data lines DL1, DL2, . . . , DLM. The first through N-th gate lines GL1, GL2, . . . , GLN may be included in the plurality of gate lines GL in FIG. 1, and the first through M-th data lines DL1, DL2, . . . , DLM may be included in the plurality of data lines DL in FIG. 1.

The plurality of pixels 120 may include a plurality of first color pixels 121, a plurality of second color pixels 122, and a plurality of third color pixels 123. The plurality of first color pixels 121 may be arranged in the first direction D1. The plurality of second color pixels 122 may be arranged at a first side (e.g., a bottom side) with respect to the plurality of first color pixels 121, and may be arranged in the first direction D1. The plurality of third color pixels 123 may be arranged at the first side with respect to the plurality of second color pixels 122, and arranged in the first direction D1. For example, the plurality of first color pixels 121 may include blue pixels B, the plurality of second color pixels 122 may include green pixels G, and the plurality of third color pixels 123 may include red pixels R. The plurality of first, second, and third color pixels 121, 122, and 123 may be repeated in that order along the second direction D2.

The first gate line GL1 may drive a first blue pixel row, and may output a first blue pixel row gate signal B1. The second gate line GL2 may drive a first green pixel row, and may output a first green pixel row gate signal G1. The third gate line GL3 may drive a first red pixel row, and may output a first red pixel row gate signal R1.

Similarly, the fourth gate line GL4 may output a second blue pixel row gate signal B2. The fifth gate line GL5 may output a second green pixel row gate signal G2. The sixth gate line GL6 may output a second red pixel row gate signal R2. The seventh gate line GL7 may output a third blue pixel row gate signal B3. The eighth gate line GL8 may output a third green pixel row gate signal G3. The ninth gate line GL9 may output a third red pixel row gate signal R3. The tenth gate line GL10 may output a fourth blue pixel row gate signal B4. The eleventh gate line GL11 may output a fourth green pixel row gate signal G4. The twelfth gate line GL12 may output a fourth red pixel row gate signal R4.

For example, in the first through N-th gate lines GL1, GL2, . . . , GLN, N may be 6480. The (N−11)-th gate line GL(N−11) may drive a 2157-th blue pixel row, and may output a 2157-th blue pixel row gate signal B2157. The (N−10)-th gate line GL(N−10) may drive a 2157-th green pixel row, and may output a 2157-th green pixel row gate signal G2157. The (N−9)-th gate line GL(N−9) may drive a 2157-th red pixel row, and may output a 2157-th red pixel row gate signal R2157.

Similarly, the (N−8)-th gate line GL(N−8) may output a 2158-th blue pixel row gate signal B2158. The (N−7)-th gate line GL(N−7) may output a 2158-th green pixel row gate signal G2158. The (N−6)-th gate line GL(N−6) may output a 2158-th red pixel row gate signal R2158. The (N−5)-th gate line GL(N−5) may output a 2159-th blue pixel row gate signal B2159. The (N−4)-th gate line GL(N−4) may output a 2159-th green pixel row gate signal G2159. The (N−3)-th gate line GL(N−3) may output a 2159-th red pixel row gate signal R2159. The (N−2)-th gate line GL(N−2) may output a 2160-th blue pixel row gate signal B2160. The (N−1)-th gate line GL(N−1) may output a 2160-th green pixel row gate signal G2160. The N-th gate line GLN may output a 2160-th red pixel row gate signal R2160.

The first through fourth blue pixel row gate signals B1, B2, B3, and B4, the first through fourth green pixel row gate signals G1, G2, G3, and G4, the first through fourth red pixel row gate signals R1, R2, R3, and R4, the 2157-th through 2160-th blue pixel row gate signals B2157, B2158, B2159, and B2160, the 2157-th through 2160-th green pixel row gate signals G2157, G2158, G2159, and G2160, and the 2157-th through 2160-th red pixel row gate signals R2157, R2158, R2159, and R2160 may be included in the plurality of gate signals GS in FIG. 1.

Each of the first through M-th data lines DL1, DL2, . . . , DLM may be, for a first column of pixels in the second direction D2 on a left side thereof and a second column of pixels in the second direction D2 on a right side thereof, alternately connected to pixels in the first column and pixels in the second column.

For example, the second data line DL2 may be connected to a blue pixel in a first pixel row and a second pixel column on a right side thereof, a green pixel in a second pixel row and a first pixel column on a left side thereof, a red pixel in a third pixel row and the second pixel column, a blue pixel in a fourth pixel row and the first pixel column, etc.

Figure 3A:
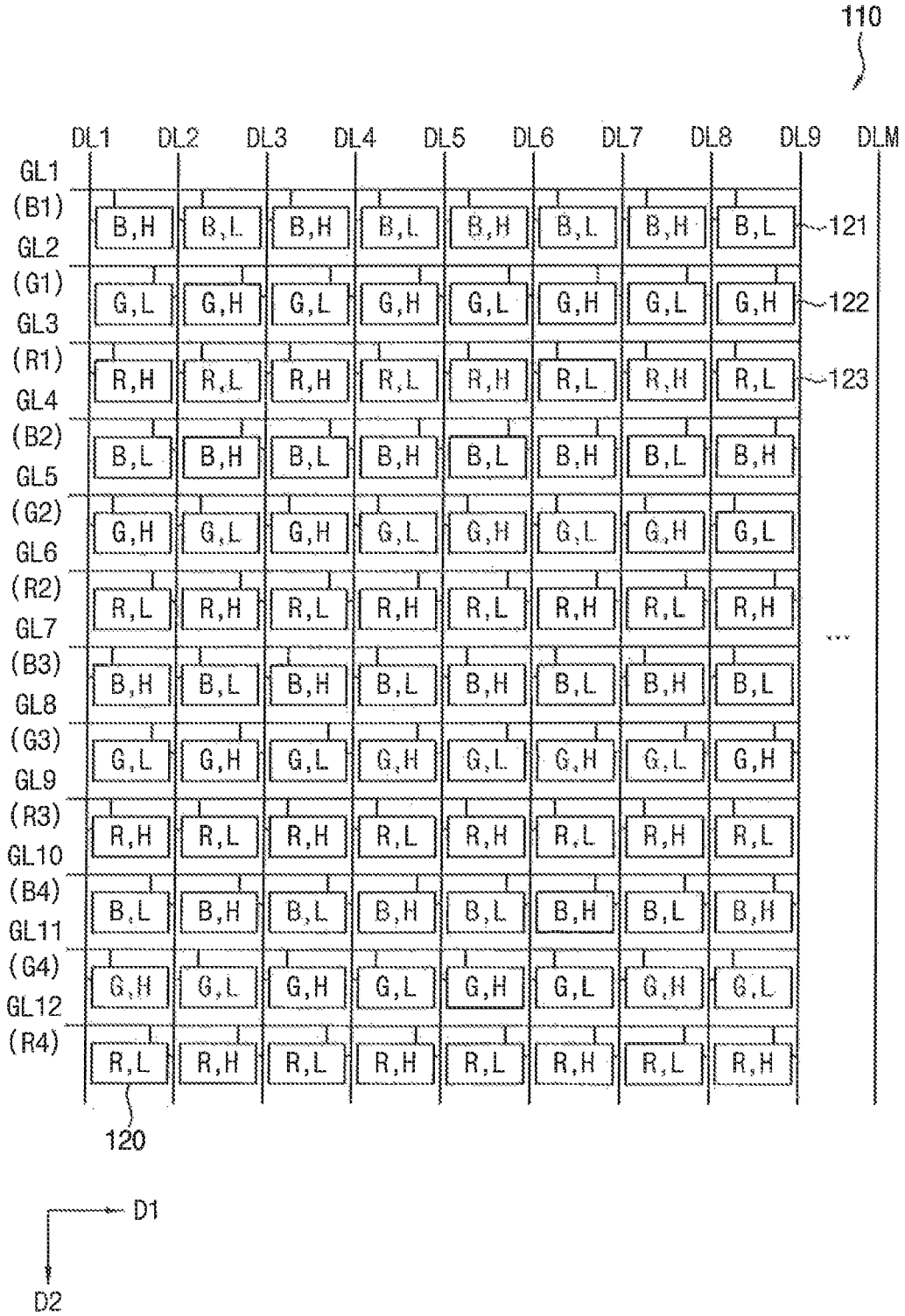
FIGS. 3A and 3B are plan views illustrating an operation of the display panel of FIGS. 2A and 2B in which a plurality of data signals generated based on a high gamma voltage and a low gamma voltage are applied to a plurality of pixels according to an exemplary embodiment of the inventive concept.
Figure 3B:
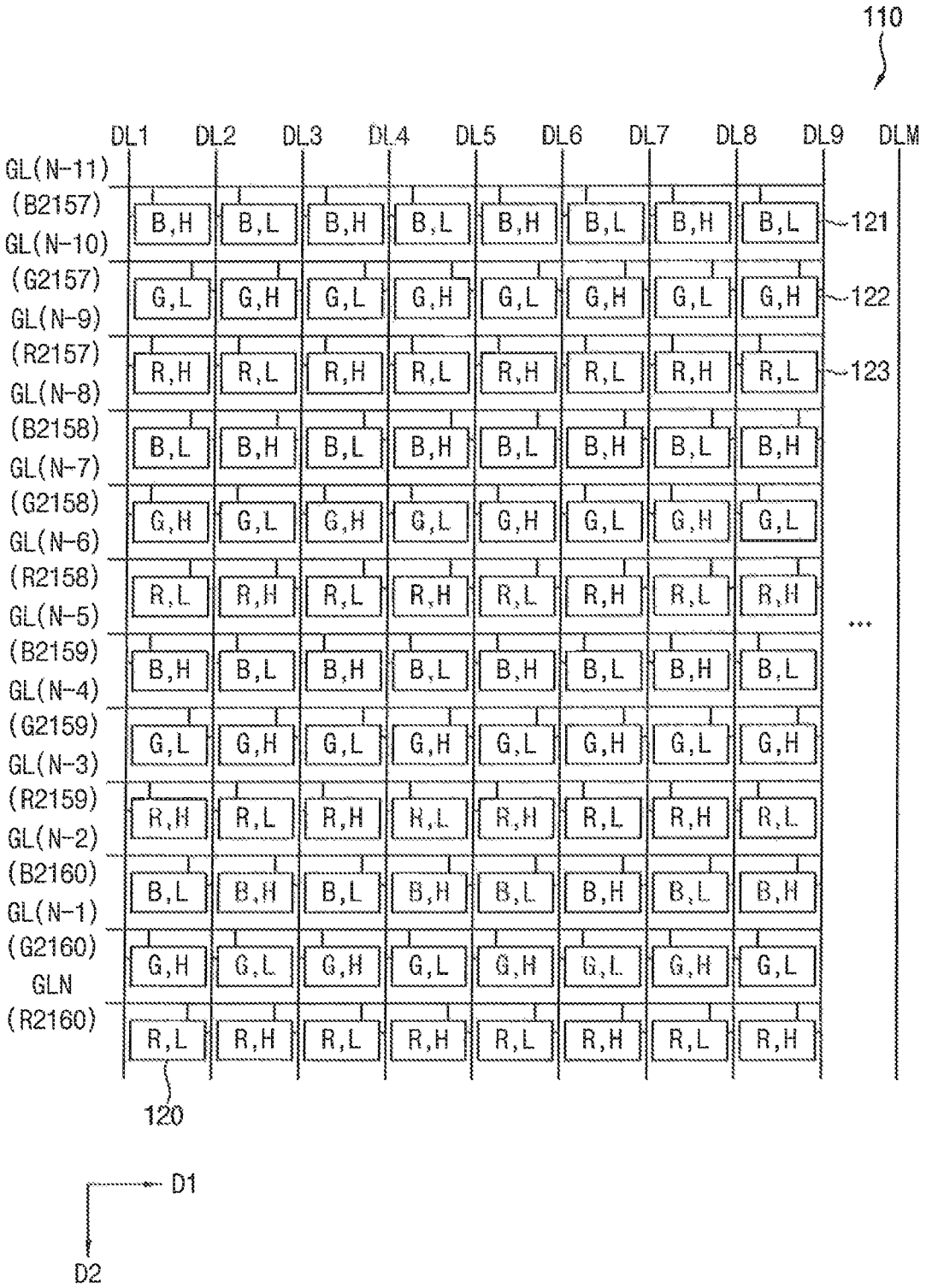

FIGS. 3A and 3B are plan views illustrating an operation of the display panel of FIGS. 2A and 2B in which a plurality of data signals generated based on a high gamma voltage and a low gamma voltage are applied to a plurality of pixels according to an exemplary embodiment of the inventive concept.

Referring to FIGS. 1, 3A, and 3B, the data driving circuit 140 receives the high gamma voltage HGV and the low gamma voltage LGV from the gamma voltage generating circuit 160. The data driving circuit 140 generates some of the plurality of data signals DS based on the high gamma voltage HGV and the other of the plurality of data signals DS based on the low gamma voltage LGV. The data driving circuit 140, alternately for every pixel in the first direction D1, applies a high gamma data voltage H based on the high gamma voltage HGV and a low gamma data voltage L based on the low gamma voltage LGV to the plurality of pixels 120. In addition, the data driving circuit 140, alternately for every pixel in the second direction D2, applies the high gamma data voltage H based on the high gamma voltage HGV and the low gamma data voltage L based on the low gamma voltage LGV to the plurality of pixels 120. Thus, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2. In other words, the high and low gamma data voltages H and L are, alternately for every pixel in the first and second directions D1 and D2, charged to the plurality of pixels 120.

Figure 4A:
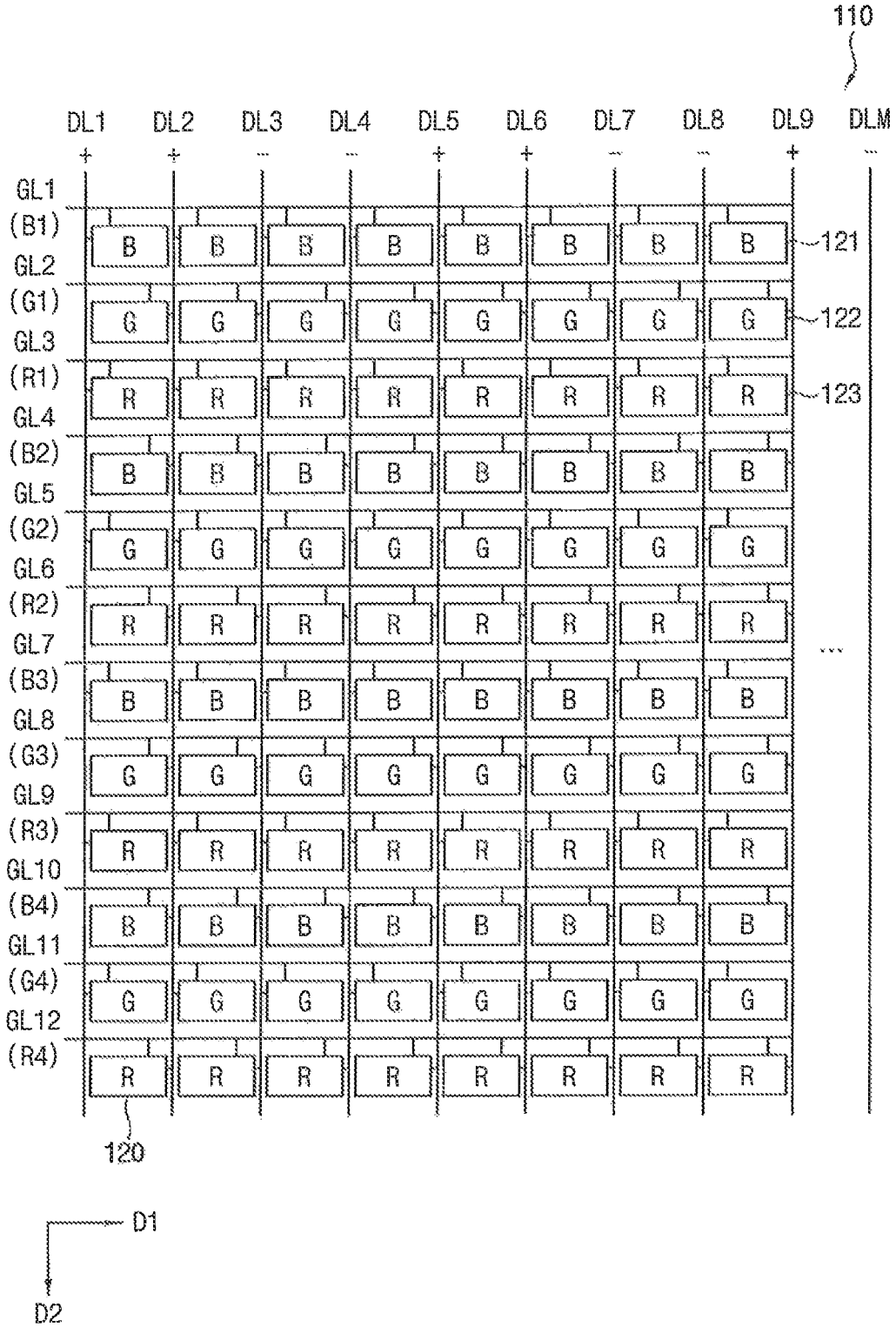
FIGS. 4A and 4B are plan views illustrating an operation of the display panel of FIGS. 2A and 2B in which a plurality of data signals generated based on a positive polarity and a negative polarity are applied to a plurality of data lines according to an exemplary embodiment of the inventive concept.
Figure 4B:
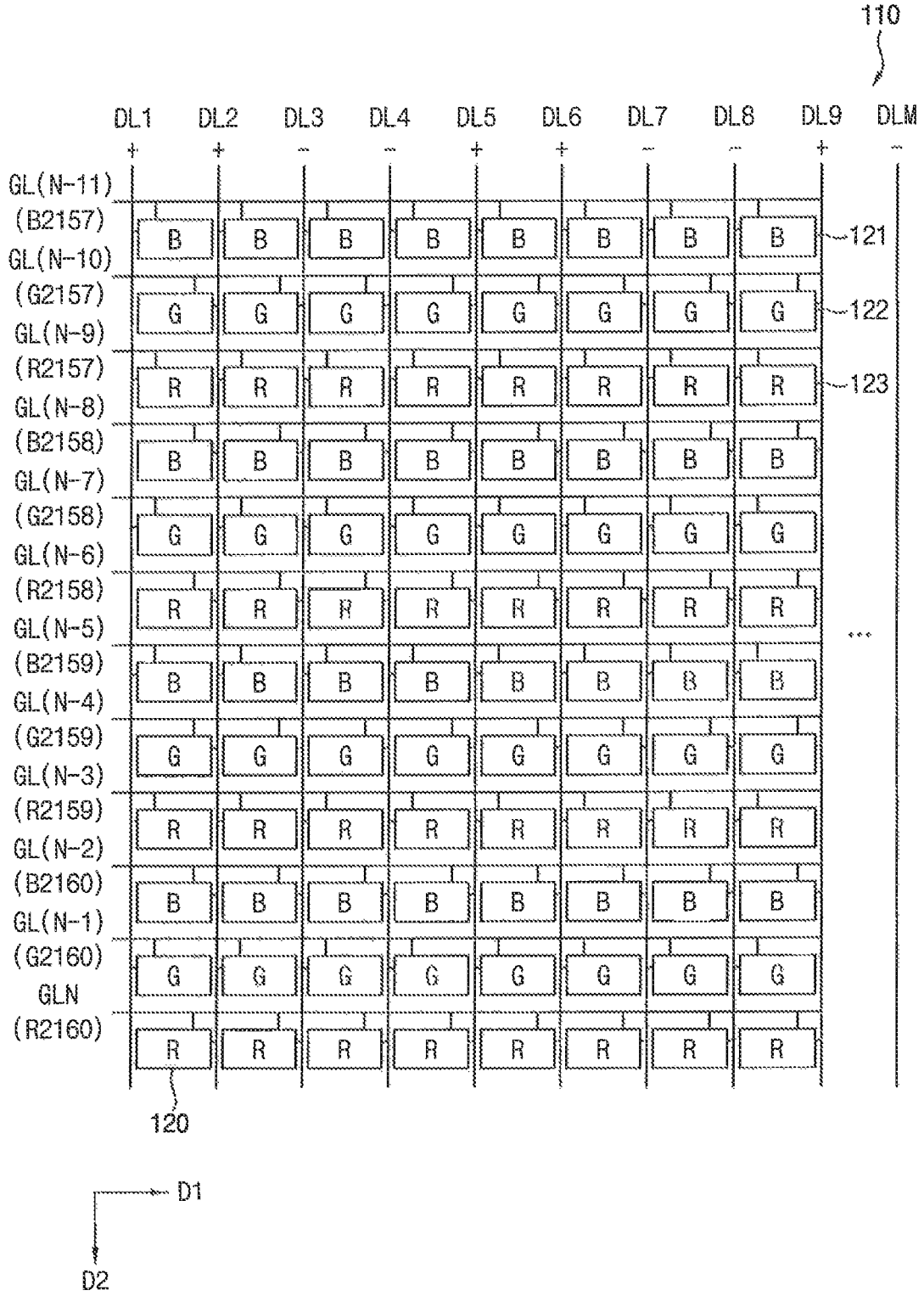
Figure 5:
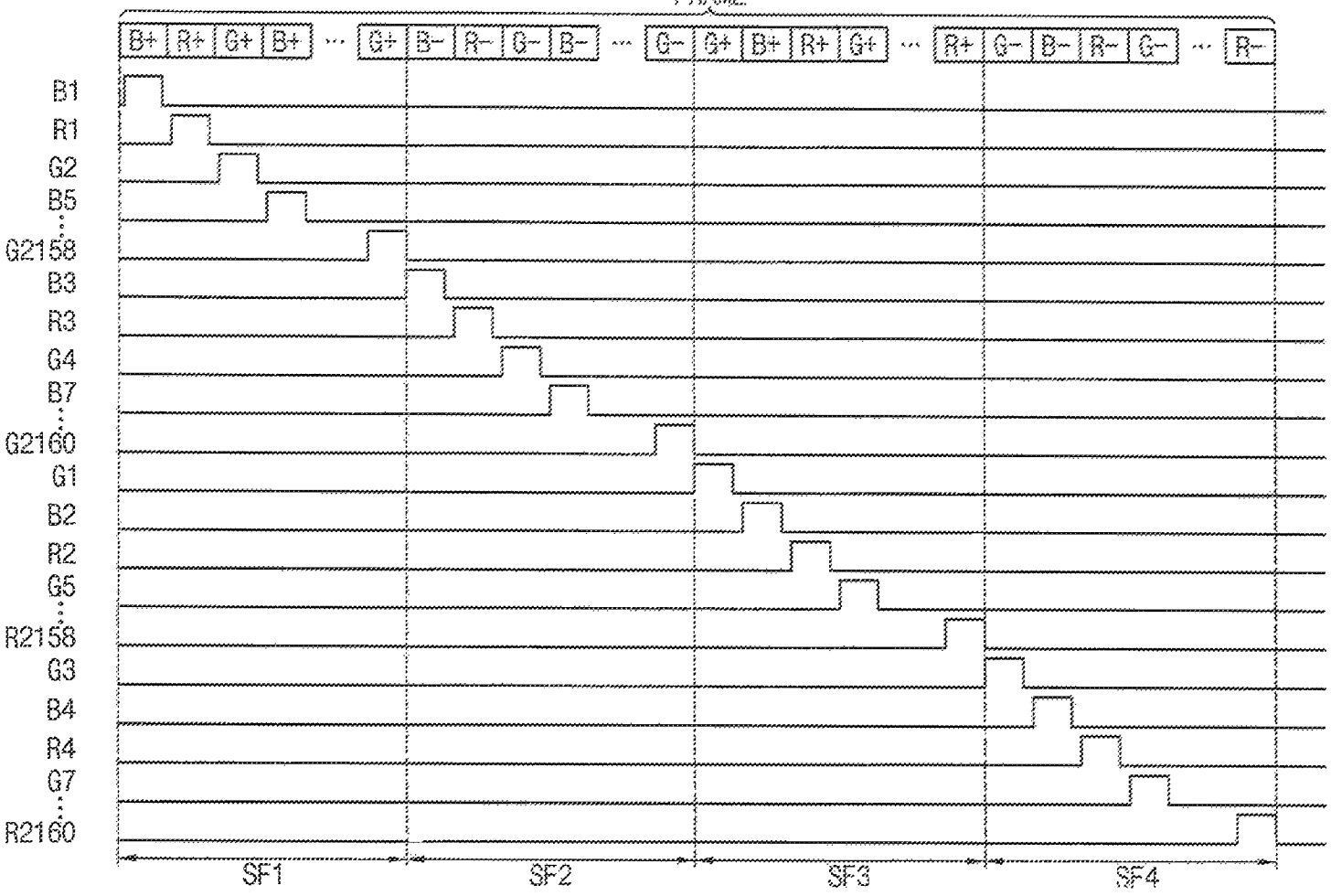
FIG. 5 is a timing diagram illustrating a plurality of data signals and a plurality of gate signals that are applied to the display panel of FIGS. 2A and 2B according to an exemplary embodiment of the inventive concept.

FIGS. 4A and 4B are plan views illustrating an operation of the display panel of FIGS. 2A and 2B in which a plurality of data signals generated based on a positive polarity and a negative polarity are applied to a plurality of data lines according to an exemplary embodiment of the inventive concept. FIG. 5 is a timing diagram illustrating a plurality of data signals and a plurality of gate signals that are applied to the display panel of FIGS. 2A and 2B according to an exemplary embodiment of the inventive concept.

Referring to FIGS. 1, 4A, 4B, and 5, a frame period FRAME includes a first subframe period SF1, a second subframe period SF2 subsequent to the first subframe period SF1, a third subframe period SF3 subsequent to the second subframe period SF2, and a fourth subframe period SF4 subsequent to the third subframe period SF3.

The gate driving circuit 130 sequentially drives K-th, (K+2)-th, (K+4)-th, (K+12)-th, (K+14)-th, (K+16)-th, (K+24)-th, . . . , (N−11)-th, (N−9)-th, and (N−7)-th gate lines during the first subframe period SF1, sequentially drives (K+6)-th, (K+8)-th, (K+10)-th, (K+18)-th, (K+20)-th, (K+22)-th, (K+30)-th, . . . , (N−5)-th, (N−3)-th, and (N−1)-th gate lines during the second subframe period SF2, sequentially drives (K+1)-th, (K+3)-th, (K+5)-th, (K+13)-th, (K+15)-th, (K+17)-th, (K+25)-th, . . . , (N−10)-th, (N−8)-th, and (N−6)-th gate lines, during the third subframe period SF3, and sequentially drives (K+7)-th, (K+9)-th, (K+11)-th, (K+19)-th, (K+21)-th, (K+23)-th, (K+31)-th, . . . , (N−4)-th, (N−2)-th, and N-th gate lines during the fourth subframe period SF4, where K is a natural number less than N.

For example, during the first subframe period SF1, the gate driving circuit 130 may sequentially drive the first gate line GL1, the third gate line GL3, the fifth gate line GL5, the thirteenth gate line GL13, . . . , and the (N−7)-th gate line GL(N−7). During the second subframe period SF2, the gate driving circuit 130 may sequentially drive the seventh gate line GL7, the ninth gate line GL9, the eleventh gate line GL11, the nineteenth gate line GL19, . . . , and the (N−1)-th gate line GL(N−1). During the third subframe period SF3, the gate driving circuit 130 may sequentially drive the second gate line GL2, the fourth gate line GL4, the sixth gate line GL6, the fourteenth gate line GL14, . . . , and the (N−6)-th gate line GL(N−6). During the fourth subframe period SF4, the gate driving circuit 130 may sequentially drive the eighth gate line GL8, the tenth gate line GL10, the twelfth gate line GL12, the twentieth gate line GL20, . . . , and the N-th gate line GLN.

During the first subframe period SF1, the gate driving circuit 130 may sequentially output the first blue pixel row gate signal B1, the first red pixel row gate signal R1, the second green pixel row gate signal G2, . . . , and the 2158-th green pixel row gate signal G2158. During the second subframe period SF2, the gate driving circuit 130 may sequentially output the third blue pixel row gate signal B3, the third red pixel row gate signal R3, the fourth green pixel row gate signal G4, . . . , and the 2160-th green pixel row gate signal G2160. During the third subframe period SF3, the gate driving circuit 130 may sequentially output the first green pixel row gate signal G1, the second blue pixel row gate signal B2, the second red pixel row gate signal R2, . . . , and the 2158-th red pixel row gate signal R2158. During the fourth subframe period SF4, the gate driving circuit 130 may sequentially output the third green pixel row gate signal G3, the fourth blue pixel row gate signal B4, the fourth red pixel row gate signal R4, . . . , and the 2160-th red pixel row gate signal R2160.

The plurality of data signals DS are reversed in polarity for every two data lines in the first direction D1. For example, during the first subframe period SF1, the data driving circuit 140 may output a data signal having a positive polarity (+) to the first data line DL1, may output a data signal having the positive polarity (+) to the second data line DL2, may output a data signal having a negative polarity (−) opposite to the positive polarity (+) to the third data line DL3, and may output a data signal having the negative polarity (−) to the fourth data line DL4. Similarly, the data driving circuit 140 may output a data signal having the positive polarity (+) to the fifth data line DL5, may output a data signal having the positive polarity (+) to the sixth data line DL6, may output a data signal having the negative polarity (−) to the seventh data line DL7, and may output a data signal having the negative polarity (−) to the eighth data line DL8. For example, the positive polarity (+) may be referred to as a first polarity, and the negative polarity (−) may be referred to as a second polarity.

In addition, the plurality of data signals DS are reversed in polarity for every subframe. For example, for a single data line, the data driving circuit 140 may output first data signals having the positive polarity (+) during the first subframe period SF1, may output second data signals having the negative polarity (−) during the second subframe period SF2, may output third data signals having the positive polarity (+) during the third subframe period SF3, and may output fourth data signals having the negative polarity (−) during the fourth subframe period SF4.

For example, during the first subframe period SF1, the data driving circuit 140 may sequentially output a blue positive data signal B+, a red positive data signal R+, and a green positive data signal G+ to the second data line DL2. During the second subframe period SF2, the data driving circuit 140 may sequentially output a blue negative data signal B−, a red negative data signal R−, and a green negative data signal G− to the second data line DL2. During the third subframe period SF3, the data driving circuit 140 may sequentially output a green positive data signal G+, a blue positive data signal B+, and a red positive data signal R+ to the second data line DL2. During the fourth subframe period SF4, the data driving circuit 140 may sequentially output a green negative data signal G−, a blue negative data signal B−, and a red negative data signal R− to the second data line DL2.

Figure 6A:
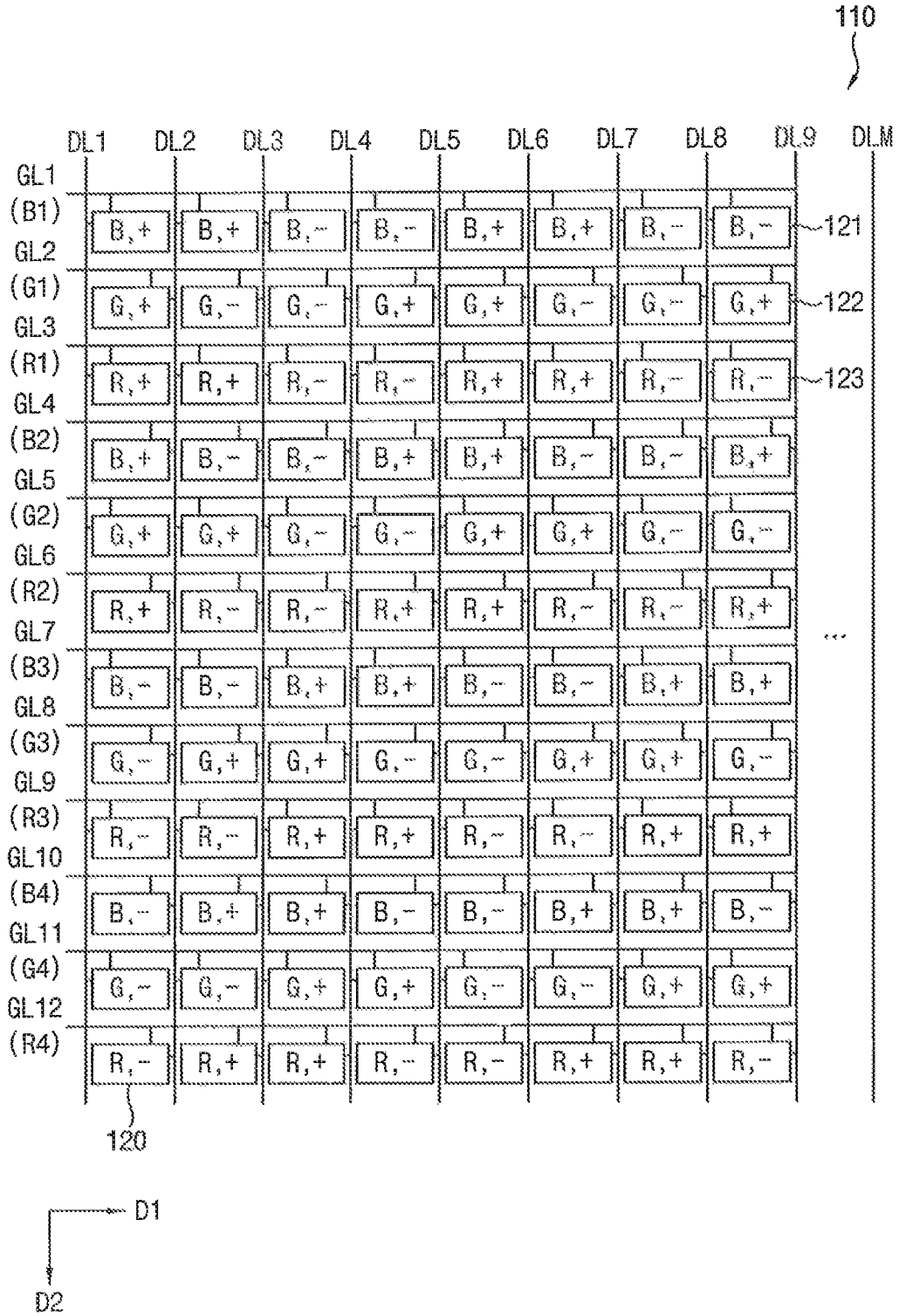
FIGS. 6A and 6B are plan views illustrating an operation of the display panel of FIGS. 2A and 2B in which a plurality of data signals generated based on a positive polarity and a negative polarity are applied to a plurality of pixels according to an exemplary embodiment of the inventive concept.
Figure 6B:
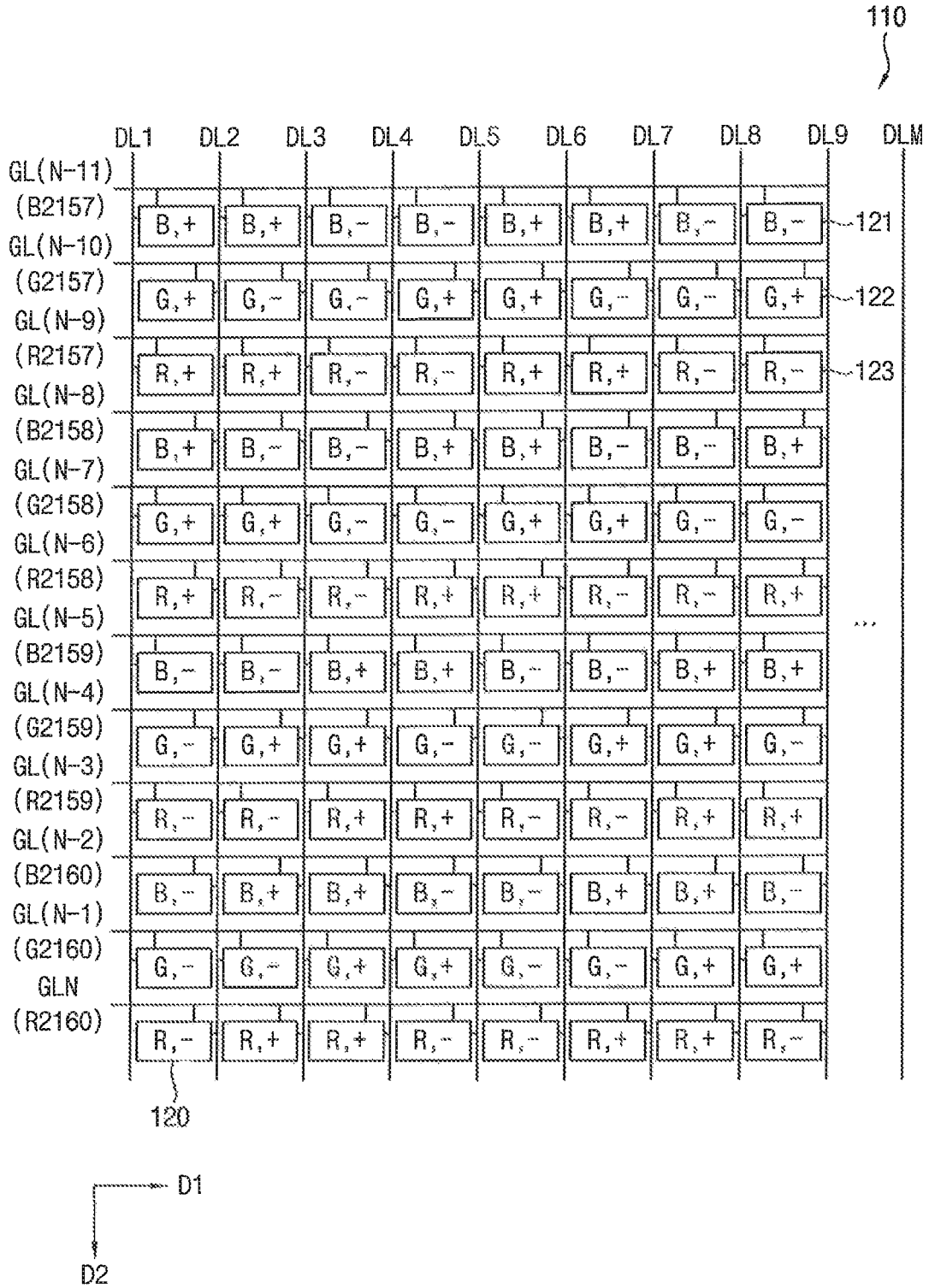

FIGS. 6A and 6B are plan views illustrating an operation of the display panel of FIGS. 2A and 2B in which a plurality of data signals generated based on a positive polarity and a negative polarity are applied to a plurality of pixels according to an exemplary embodiment of the inventive concept.

Referring to FIGS. 1, 4A, 4B, 5, 6A, and 6B, based on the operations of the gate driving circuit 130 and the data driving circuit 140, the plurality of pixels 120 are reversed in polarity for every two pixels in the first direction D1 and for every six pixels in the second direction D2. In other words, polarities of pixels in each row in the first direction D1 of the plurality of pixels 120 alternate according to a first pattern, e.g., every two pixels, and polarities of pixels in each column in the second direction D2 of the plurality of pixels 120 alternate according to a second pattern, e.g., every six pixels.

Figure 7A:
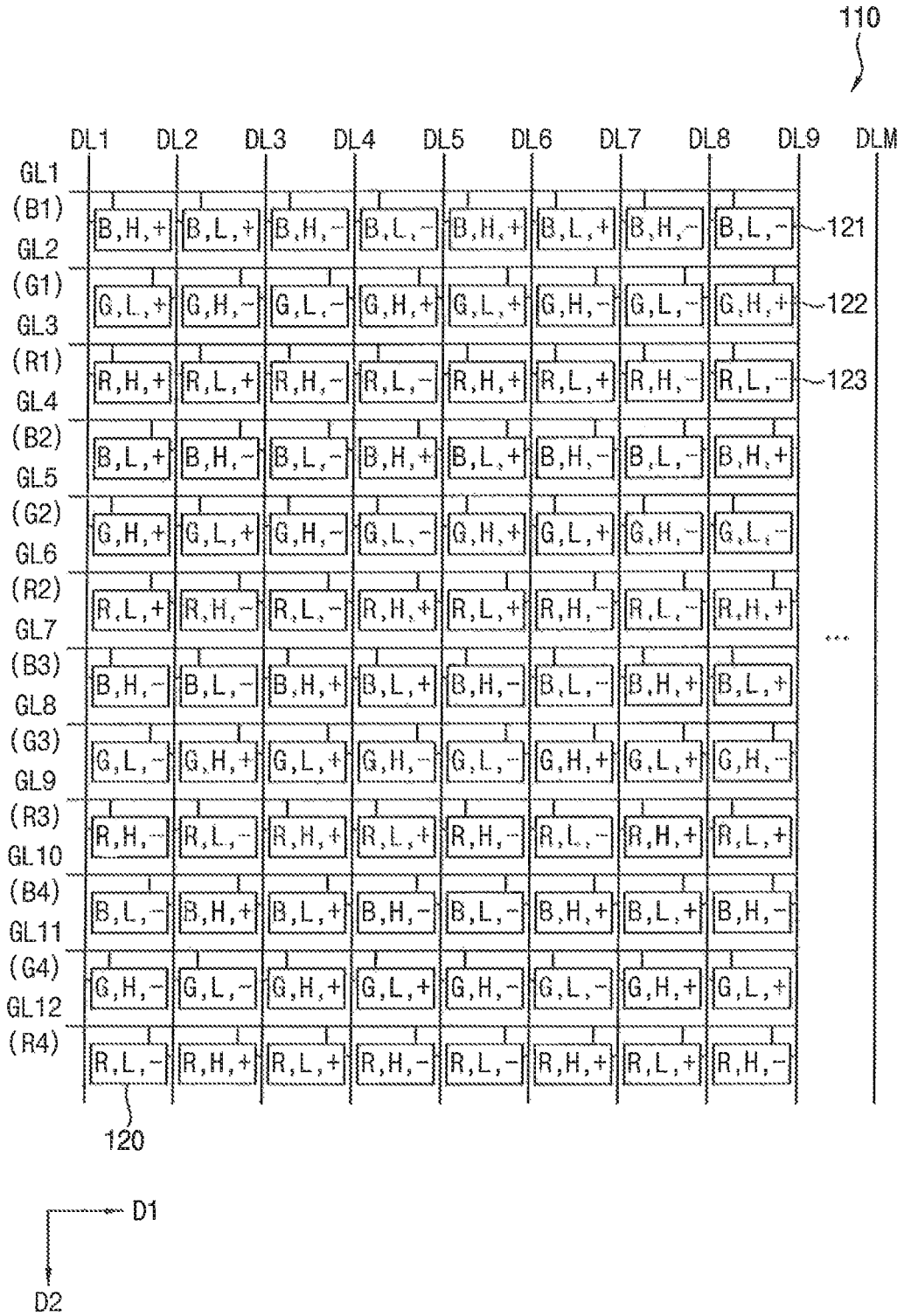
FIGS. 7A and 7B are plan views illustrating an operation of the display panel of FIGS. 2A and 2B in which a plurality of data signals generated based on high and low gamma voltages and positive and negative polarities are applied to a plurality of pixels according to an exemplary embodiment of the inventive concept.
Figure 7B:
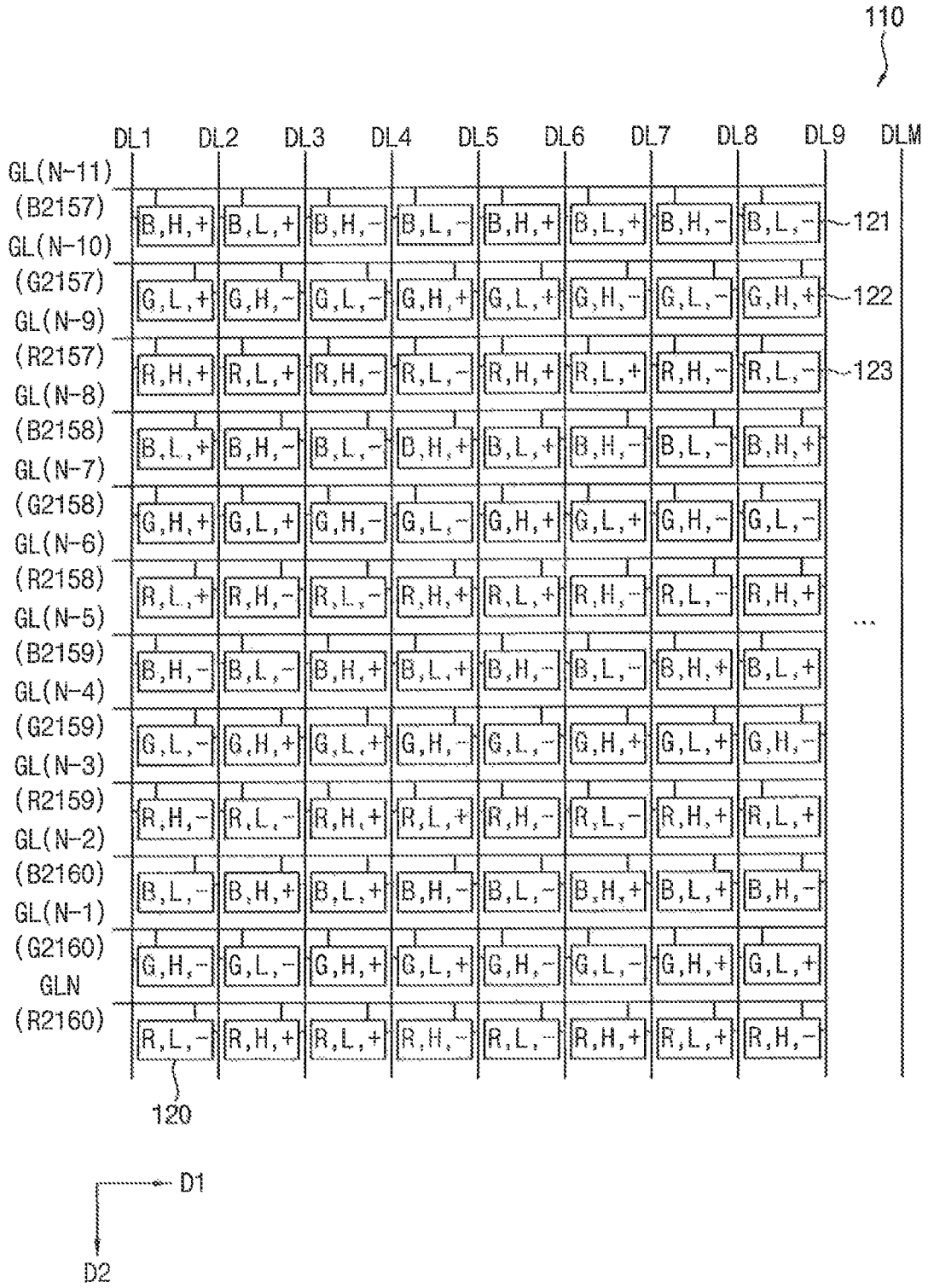

FIGS. 7A and 7B are plan views illustrating an operation of the display panel of FIGS. 2A and 2B in which a plurality of data signals generated based on high and low gamma voltages and positive and negative polarities are applied to a plurality of pixels according to an exemplary embodiment of the inventive concept.

Referring to FIGS. 1, 2A, 2B, 3A, 3B, 4A, 4B, 5, 6A, 6B, 7A, and 7B, based on the operation of the data driving circuit 140, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2.

Based on the operations of the gate driving circuit 130 and the data driving circuit 140, the plurality of pixels 120 are reversed in polarity for every two pixels in the first direction D1 and for every six pixels in the second direction D2.

Figure 8:
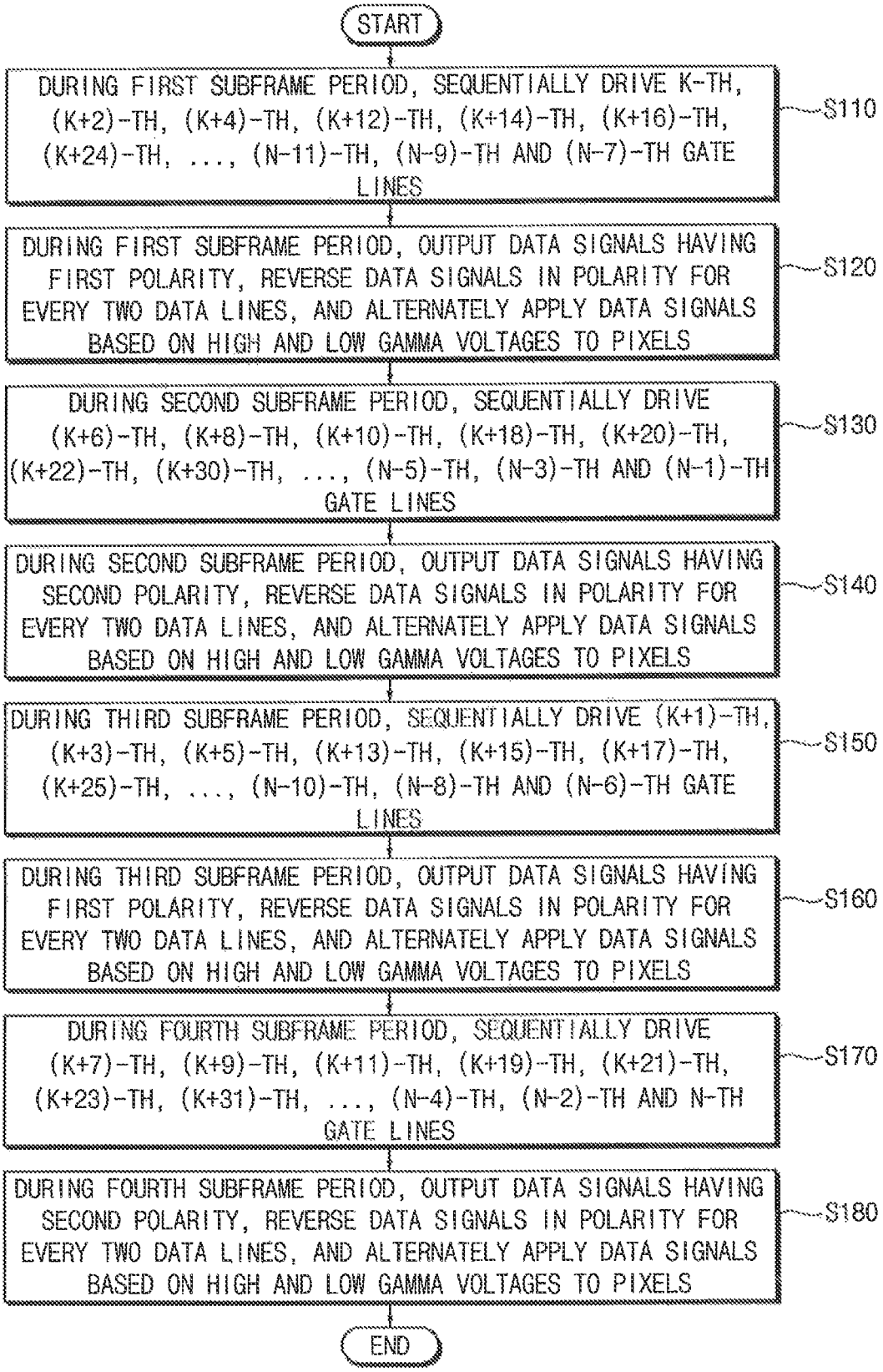
FIG. 8 is a flowchart illustrating a method of driving a display apparatus according to an exemplary embodiment of the inventive concept.

FIG. 8 is a flowchart illustrating a method of driving a display apparatus according to an exemplary embodiment of the inventive concept.

Referring to FIGS. 1 through 8, during the first subframe period SF1, the K-th, (K+2)-th, (K+4)-th, (K+12)-th, (K+14)-th, (K+16)-th, (K+24)-th, . . . , (N−11)-th, (N−9)-th, and (N−7)-th gate lines are sequentially driven (operation S110). For example, the gate driving circuit 130 sequentially drives the K-th, (K+2)-th, (K+4)-th, (K+12)-th, (K+14)-th, (K+16)-th, (K+24)-th, . . . , (N−11)-th, (N−9)-th, and (N−7)-th gate lines during the first subframe period SF1. During the first subframe period SF1, the gate driving circuit 130 may sequentially drive the first gate line GL1, the third gate line GL3, the fifth gate line GL5, the thirteenth gate line GL13, . . . , and the (N−7)-th gate line GL(N−7). During the first subframe period SF1, the gate driving circuit 130 may sequentially output the first blue pixel row gate signal B1, the first red pixel row gate signal R1, the second green pixel row gate signal G2, . . . , and the 2158-th green pixel row gate signal G2158.

During the first subframe period SF1, data signals having the first polarity are output, the data signals are reversed in polarity for every two data lines in the first direction D1, and the data signals based on the high gamma voltage HGV and the low gamma voltage LGV are alternately applied to the plurality of pixels 120 (operation S120).

For example, the data driving circuit 140 receives the high gamma voltage HGV and the low gamma voltage LGV from the gamma voltage generating circuit 160. The data driving circuit 140 generates some of the data signals based on the high gamma voltage HGV and the other of the data signals based on the low gamma voltage LGV. The data driving circuit 140, alternately for every pixel in the first direction D1, applies the high gamma data voltage H based on the high gamma voltage HGV and the low gamma data voltage L based on the low gamma voltage LGV to the plurality of pixels 120. In addition, the data driving circuit 140, alternately for every pixel in the second direction D2, applies the high gamma data voltage H based on the high gamma voltage HGV and the low gamma data voltage L based on the low gamma voltage LGV to the plurality of pixels 120. Thus, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2. In other words, the high and low gamma data voltages H and L are, alternately for every pixel in the first and second directions D1 and D2, charged to the plurality of pixels 120.

In addition, the data signals are reversed in polarity for every two data lines in the first direction D1. For example, the data driving circuit 140 may output a data signal having the positive polarity (+) to the first data line DL1, may output a data signal having the positive polarity (+) to the second data line DL2, may output a data signal having the negative polarity (−) to the third data line DL3, and may output a data signal having the negative polarity (−) to the fourth data line DL4. Similarly, the data driving circuit 140 may output a data signal having the positive polarity (+) to the fifth data line DL5, may output a data signal having the positive polarity (+) to the sixth data line DL6, may output a data signal having the negative polarity (−) to the seventh data line DL7, and may output a data signal having the negative polarity (−) to the eighth data line DL8.

Further, for a single data line, the data driving circuit 140 may output the data signals having the same polarity during the first subframe period SF1. For example, the data driving circuit 140 may sequentially output a blue positive data signal B+, a red positive data signal R+, and a green positive data signal G+ to the second data line DL2.

During the second subframe period SF2, the (K+6)-th, (K+8)-th, (K+10)-th, (K+18)-th, (K+20)-th, (K+22)-th, (K+30)-th, . . . , (N−5)-th, (N−3)-th, and (N−1)-th gate lines are sequentially driven (operation S130). For example, the gate driving circuit 130 sequentially drives the (K+6)-th, (K+8)-th, (K+10)-th, (K+18)-th, (K+20)-th, (K+22)-th, (K+30)-th, . . . , (N−5)-th, (N−3)-th, and (N−1)-th gate lines during the second subframe period SF2. During the second subframe period SF2, the gate driving circuit 130 may sequentially drive the seventh gate line GL7, the ninth gate line GL9, the eleventh gate line GL11, the nineteenth gate line, . . . , and the (N−1)-th gate line GL(N−1). During the second subframe period SF2, the gate driving circuit 130 may sequentially output the third blue pixel row gate signal B3, the third red pixel row gate signal R3, the fourth green pixel row gate signal G4, . . . , and the 2160-th green pixel row gate signal G2160.

During the second subframe period SF2, data signals having the second polarity are output, the data signals are reversed in polarity for every two data lines in the first direction D1, and the data signals based on the high gamma voltage HGV and the low gamma voltage LGV are alternately applied to the plurality of pixels 120 (operation S140).

For example, the data driving circuit 140 receives the high gamma voltage HGV and the low gamma voltage LGV from the gamma voltage generating circuit 160. The data driving circuit 140 generates some of the data signals based on the high gamma voltage HGV and the other of the data signals based on the low gamma voltage LGV. The data driving circuit 140, alternately for every pixel in the first direction D1, applies the high gamma data voltage H based on the high gamma voltage HGV and the low gamma data voltage L based on the low gamma voltage LGV to the plurality of pixels 120. In addition, the data driving circuit 140, alternately for every pixel in the second direction D2, applies the high gamma data voltage H based on the high gamma voltage HGV and the low gamma data voltage L based on the low gamma voltage LGV to the plurality of pixels 120. Thus, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2. In other words, the high and low gamma data voltages H and L are, alternately for every pixel in the first and second directions D1 and D2, charged to the plurality of pixels 120.

In addition, the data signals are reversed in polarity for every two data lines in the first direction D1. For example, the data driving circuit 140 may output a data signal having the negative polarity (−) to the first data line DL1, may output a data signal having the negative polarity (−) to the second data line DL2, may output a data signal having the positive polarity (+) to the third data line DL3, and may output a data signal having the positive polarity (+) to the fourth data line DL4. Similarly, the data driving circuit 140 may output a data signal having the negative polarity (−) to the fifth data line DL5, may output a data signal having the negative polarity (−) to the sixth data line DL6, may output a data signal having the positive polarity (+) to the seventh data line DL7, and may output a data signal having the positive polarity (+) to the eighth data line DL8.

Further, for a single data line, the data driving circuit 140 may output the data signals having the same polarity during the second subframe period SF2. For example, the data driving circuit 140 may sequentially output a blue negative data signal B−, a red negative data signal R−, and a green negative data signal G− to the second data line DL2.

During the third subframe period SF3, the (K+1)-th, (K+3)-th, (K+5)-th, (K+13)-th, (K+15)-th, (K+17)-th, (K+25)-th, . . . , (N−10)-th, (N−8)-th, and (N−6)-th gate lines are sequentially driven (operation S150). For example, the gate driving circuit 130 sequentially drives the (K+1)-th, (K+3)-th, (K+5)-th, (K+13)-th, (K+15)-th, (K+17)-th, (K+25)-th, . . . , (N−10)-th, (N−8)-th, and (N−6)-th gate lines during the third subframe period SF3. During the third subframe period SF3, the gate driving circuit 130 may sequentially drive the second gate line GL2, the fourth gate line GL4, the sixth gate line GL6, the fourteenth gate line GL14, . . . , and the (N−6)-th gate line GL(N−6). During the third subframe period SF3, the gate driving circuit 130 may sequentially output the first green pixel row gate signal G1, the second blue pixel row gate signal B2, the second red pixel row gate signal R2, . . . , and the 2158-th red pixel row gate signal R2158.

During the third subframe period SF3, data signals having the first polarity are output, the data signals are reversed in polarity for every two data lines in the first direction D1, and the data signals based on the high gamma voltage HGV and the low gamma voltage LGV are alternately applied to the plurality of pixels 120 (operation S160).

For example, the data driving circuit 140 receives the high gamma voltage HGV and the low gamma voltage LGV from the gamma voltage generating circuit 160. The data driving circuit 140 generates some of the data signals based on the high gamma voltage HGV and the other of the data signals based on the low gamma voltage LGV. The data driving circuit 140, alternately for every pixel in the first direction D1, applies the high gamma data voltage H based on the high gamma voltage HGV and the low gamma data voltage L based on the low gamma voltage LGV to the plurality of pixels 120. In addition, the data driving circuit 140, alternately for every pixel in the second direction D2, applies the high gamma data voltage H based on the high gamma voltage HGV and the low gamma data voltage L based on the low gamma voltage LGV to the plurality of pixels 120. Thus, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2. In other words, the high and low gamma data voltages H and L are, alternately for every pixel in the first and second directions D1 and D2, charged to the plurality of pixels 120.

In addition, the data signals are reversed in polarity for every two data lines in the first direction D1. For example, the data driving circuit 140 may output a data signal having the positive polarity (+) to the first data line DL1, may output a data signal having the positive polarity (+) to the second data line DL2, may output a data signal having the negative polarity (−) to the third data line DL3, and may output a data signal having the negative polarity (−) to the fourth data line DL4. Similarly, the data driving circuit 140 may output a data signal having the positive polarity (+) to the fifth data line DL5, may output a data signal having the positive polarity (+) to the sixth data line DL6, may output a data signal having the negative polarity (−) to the seventh data line DL7, and may output a data signal having the negative polarity (−) to the eighth data line DL8.

Further, for a single data line, the data driving circuit 140 may output the data signals having the same polarity during the third subframe period SF3. For example, the data driving circuit 140 may sequentially output a green positive data signal G+, a blue positive data signal B+, and a red positive data signal R+ to the second data line DL2.

During the fourth subframe period SF4, the (K+7)-th, (K+9)-th, (K+11)-th, (K+19)-th, (K+21)-th, (K+23)-th, (K+31)-th, . . . , (N−4)-th, (N−2)-th, and N-th gate lines are sequentially driven (operation S170). For example, the gate driving circuit 130 sequentially drives the (K+7)-th, (K+9)-th, (K+11)-th, (K+19)-th, (K+21)-th, (K+23)-th, (K+31)-th, . . . , (N−4)-th, (N−2)-th, and N-th gate lines during the fourth subframe period SF4. During the fourth subframe period SF4, the gate driving circuit 130 may sequentially drive the eighth gate line GL8, the tenth gate line GL10, the twelfth gate line GL12, the twentieth gate line GL20, . . . , and the N-th gate line GLN. During the fourth subframe period SF4, the gate driving circuit 130 may sequentially output the third green pixel row gate signal G3, the fourth blue pixel row gate signal B4, the fourth red pixel row gate signal R4, . . . , and the 2160-th red pixel row gate signal R2160.

During the fourth subframe period SF4, data signals having the second polarity are output, the data signals are reversed in polarity for every two data lines in the first direction D1, and the data signals based on the high gamma voltage HGV and the low gamma voltage LGV are alternately applied to the plurality of pixels 120 (operation S180).

For example, the data driving circuit 140 receives the high gamma voltage HGV and the low gamma voltage LGV from the gamma voltage generating circuit 160. The data driving circuit 140 generates some of the data signals based on the high gamma voltage HGV and the other of the data signals based on the low gamma voltage LGV. The data driving circuit 140, alternately for every pixel in the first direction D1, applies the high gamma data voltage H based on the high gamma voltage HGV and the low gamma data voltage L based on the low gamma voltage LGV to the plurality of pixels 120. In addition, the data driving circuit 140, alternately for every pixel in the second direction D2, applies the high gamma data voltage H based on the high gamma voltage HGV and the low gamma data voltage L based on the low gamma voltage LGV to the plurality of pixels 120. Thus, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2. In other words, the high and low gamma data voltages H and L are, alternately for every pixel in the first and second directions D1 and D2, charged to the plurality of pixels 120.

In addition, the data signals are reversed in polarity for every two data lines in the first direction D1. For example, the data driving circuit 140 may output a data signal having the negative polarity (−) to the first data line DL1, may output a data signal having the negative polarity (−) to the second data line DL2, may output a data signal having the positive polarity (+) to the third data line DL3, and may output a data signal having the positive polarity (+) to the fourth data line DL4. Similarly, the data driving circuit 140 may output a data signal having the negative polarity (−) to the fifth data line DL5, may output a data signal having the negative polarity (−) to the sixth data line DL6, may output a data signal having the positive polarity (+) to the seventh data line DL7, and may output a data signal having the positive polarity (+) to the eighth data line DL8.

Further, for a single data line, the data driving circuit 140 may output the data signals having the same polarity during the fourth subframe period SF4. For example, the data driving circuit 140 may sequentially output a green negative data signal G−, a blue negative data signal B−, and a red negative data signal R− to the second data line DL2.

In the display apparatus 100 according to an exemplary embodiment of the inventive concept, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2, and thus the display apparatus 100 may have a relatively improved visibility from the side. In addition, in the pixels having the same color, the data signals are reversed in polarity in the first and second directions D1 and D2, and thus a moving horizontal spot and/or a moving vertical spot may be prevented. Accordingly, the display apparatus 100 may have a relatively improved display quality.

Figure 9A:
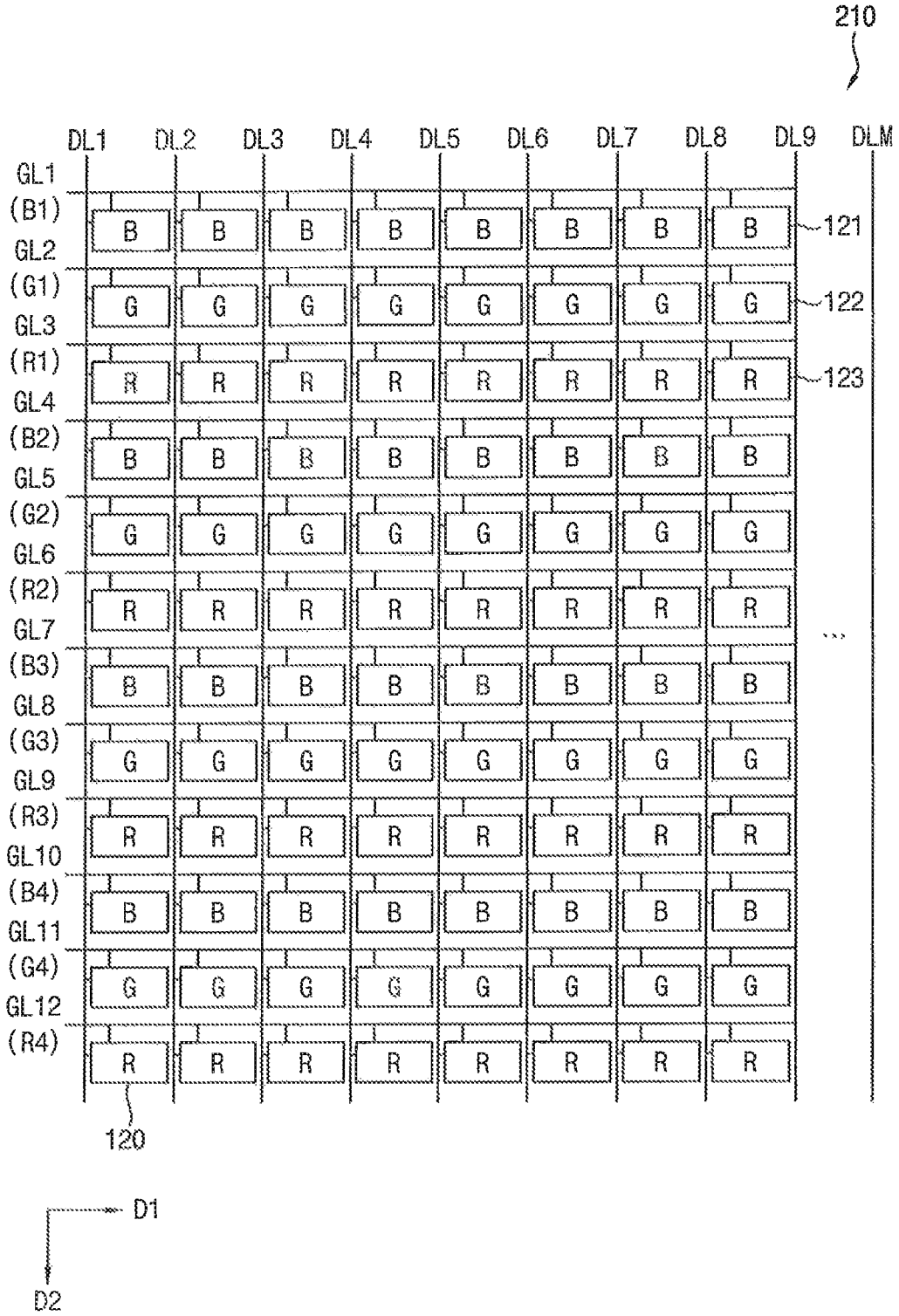
FIGS. 9A and 9B are plan views illustrating a display panel included in the display apparatus of FIG. 1 according to an exemplary embodiment of the inventive concept.
Figure 9B:
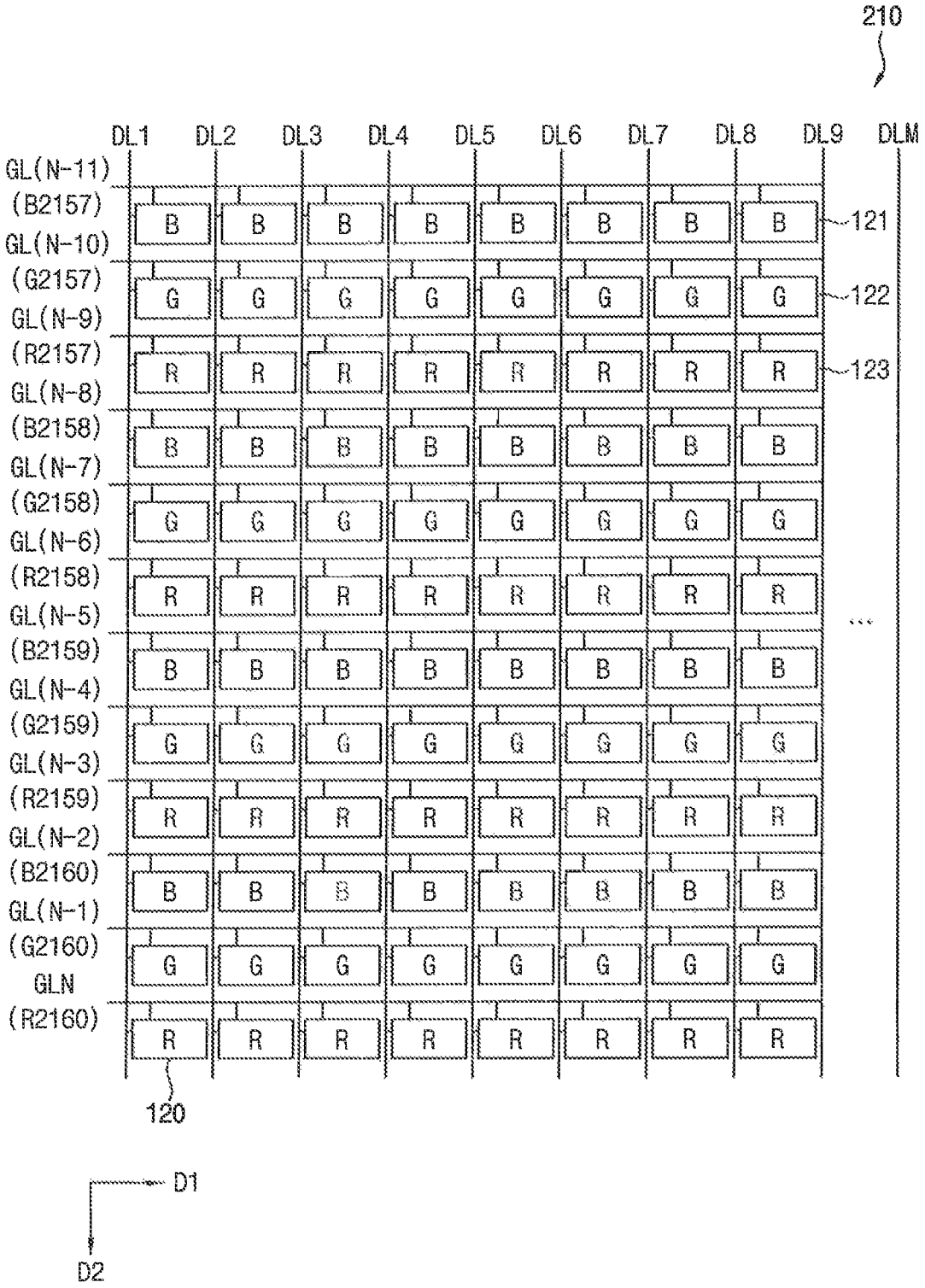

FIGS. 9A and 9B are plan views illustrating a display panel included in the display apparatus of FIG. 1 according to an exemplary embodiment of the inventive concept.

A display panel 210 illustrated in FIGS. 9A and 9B may be included in the display apparatus 100 of FIG. 1. In other words, a display apparatus including the display panel 210 of FIGS. 9A and 9B may be substantially the same as a display apparatus including the display panel 110 of FIGS. 2A and 2B, except that the display panel 110 is replaced with the display panel 210. Like reference numerals refer to like elements, and repeat descriptions are omitted.

Referring to FIGS. 1, 9A, and 9B, the display panel 210 includes first through N-th gate lines GL1, GL2, . . . , GLN and first through M-th data lines DL1, DL2, . . . , DLM, where N is a natural number greater than or equal to 48 and M is a natural number greater than or equal to 4. The display panel 210 includes the plurality of pixels 120 each of which is connected to a respective one of the first through N-th gate lines GL1, GL2, . . . , GLN and a respective one of the first through M-th data lines DL1, DL2, . . . , DLM. The first through N-th gate lines GL1, GL2, . . . , GLN may be included in the plurality of gate lines GL in FIG. 1, and the first through M-th data lines DL1, DL2, . . . , DLM may be included in the plurality of data lines DL in FIG. 1.

The plurality of pixels 120 may include the plurality of first color pixels 121, the plurality of second color pixels 122, and the plurality of third color pixels 123. The plurality of first color pixels 121 may be arranged in the first direction D1. The plurality of second color pixels 122 may be arranged at a first side (e.g., a bottom side) with respect to the plurality of first color pixels 121, and may be arranged in the first direction D1. The plurality of third color pixels 123 may be arranged at the first side with respect to the plurality of second color pixels 122, and arranged in the first direction D1. For example, the plurality of first color pixels 121 may include blue pixels B, the plurality of second color pixels 122 may include green pixels G, and the plurality of third color pixels 123 may include red pixels R. The plurality of first, second, and third color pixels 121, 122, and 123 may be repeated in the second direction D2.

Each of the first through M-th data lines DL1, DL2, . . . , DLM may be connected to some of the plurality of pixels 120 at one side thereof. For example, each of the first through M-th data lines DL1, DL2, . . . , DLM may be connected to some of the plurality of pixels 120 in a column in the second direction D2 at the right side thereof.

Figure 10A:
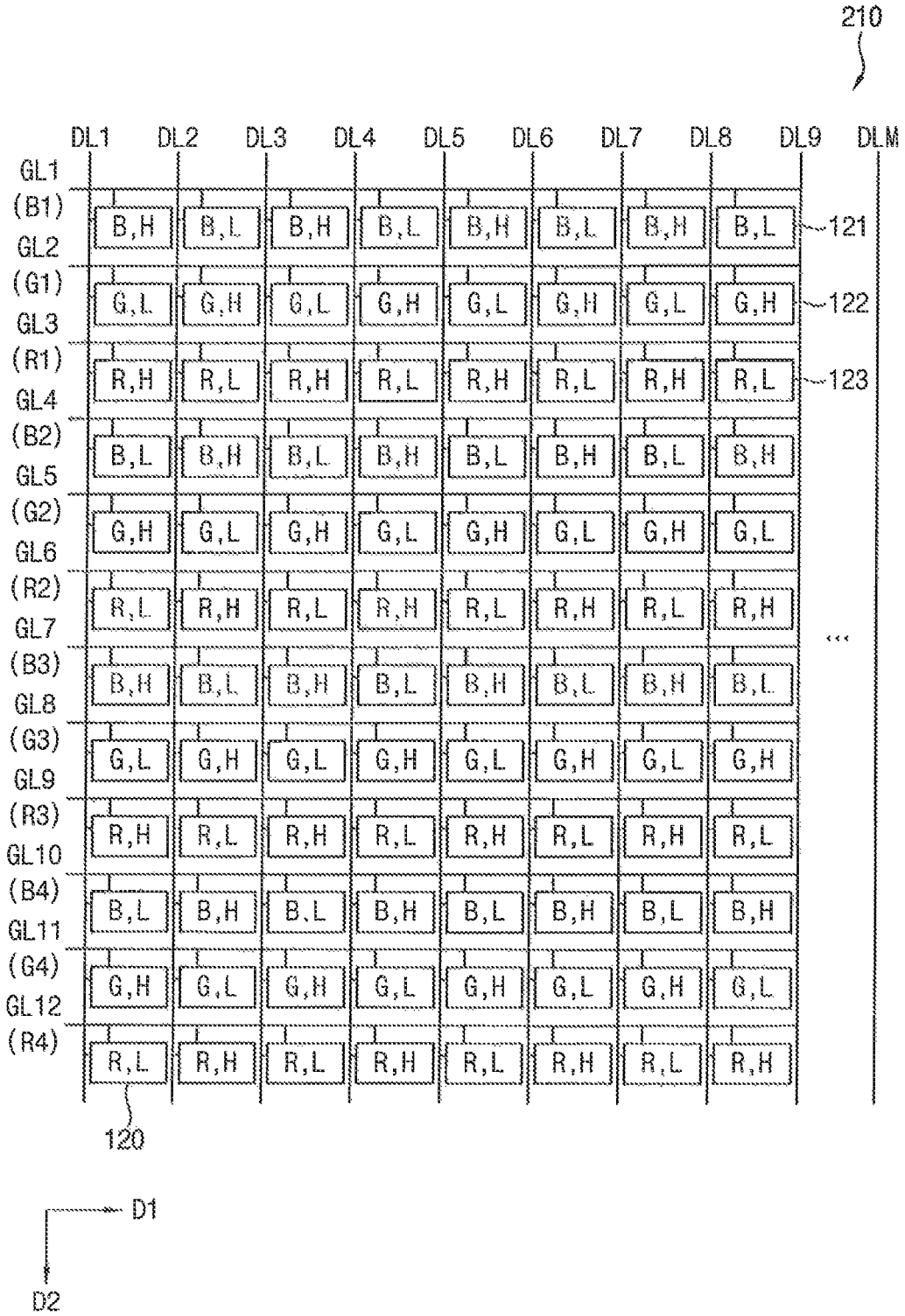
FIGS. 10A and 10B are plan views illustrating an operation of the display panel of FIGS. 9A and 9B in which a plurality of data signals generated based on a high gamma voltage and a low gamma voltage are applied to a plurality of pixels according to an exemplary embodiment of the inventive concept.
Figure 10B:
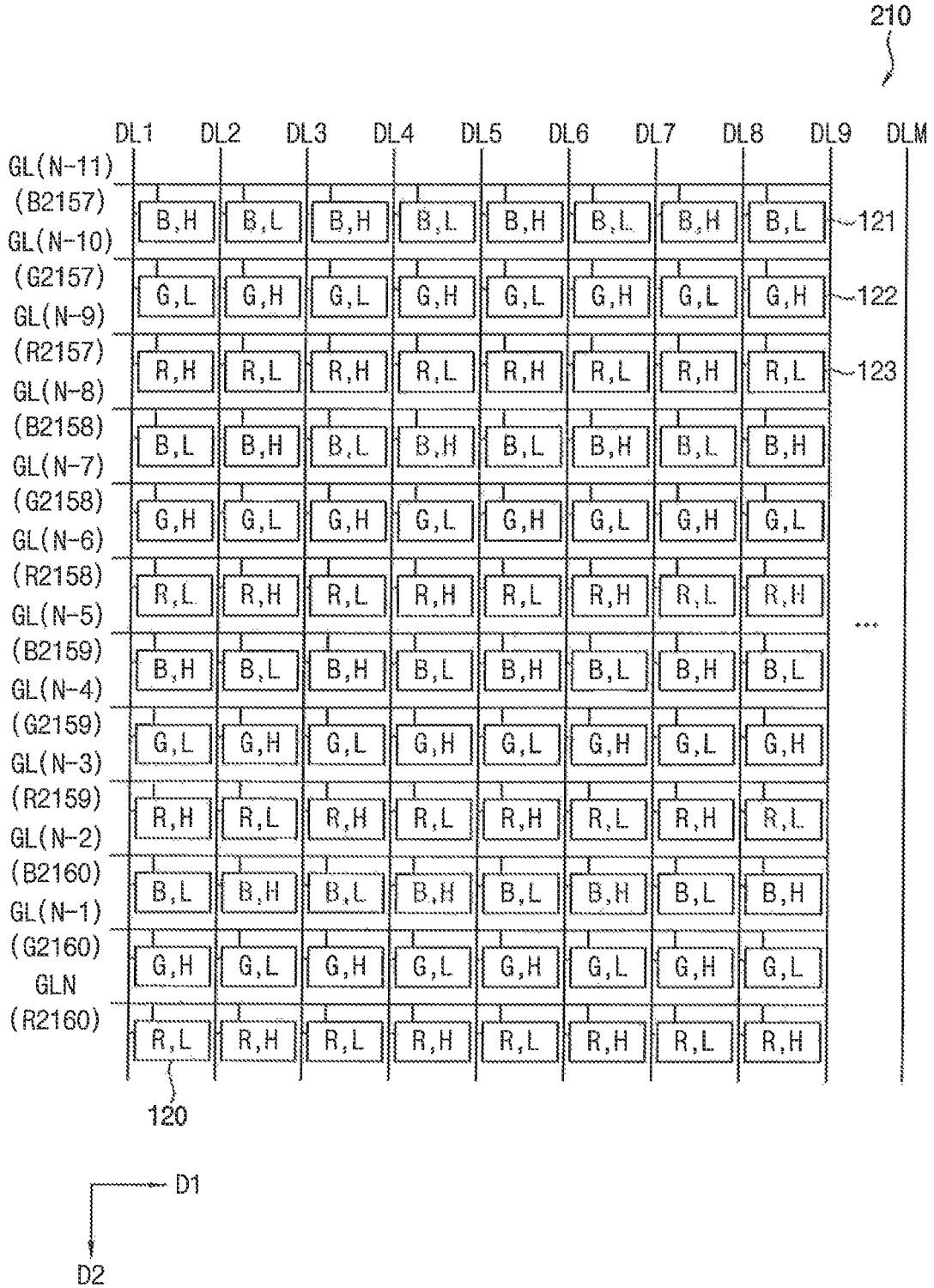

FIGS. 10A and 10B are plan views illustrating an operation of the display panel of FIGS. 9A and 9B in which a plurality of data signals generated based on a high gamma voltage and a low gamma voltage are applied to a plurality of pixels according to an exemplary embodiment of the inventive concept.

Referring to FIGS. 1, 10A, and 10B, the data driving circuit 140 receives the high gamma voltage HGV and the low gamma voltage LGV from the gamma voltage generating circuit 160. The data driving circuit 140 generates some of the plurality of data signals DS based on the high gamma voltage HGV and the other of the plurality of data signals DS based on the low gamma voltage LGV. The data driving circuit 140, alternately for every pixel in the first direction D1, applies the high gamma data voltage H based on the high gamma voltage HGV and the low gamma data voltage L based on the low gamma voltage LGV to the plurality of pixels 120. In addition, the data driving circuit 140, alternately for every pixel in the second direction D2, applies the high gamma data voltage H based on the high gamma voltage HGV and the low gamma data voltage L based on the low gamma voltage LGV to the plurality of pixels 120. Thus, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2. In other words, the high and low gamma data voltages H and L are, alternately for every pixel in the first and second directions D1 and D2, charged to the plurality of pixels 120.

Figure 11A:
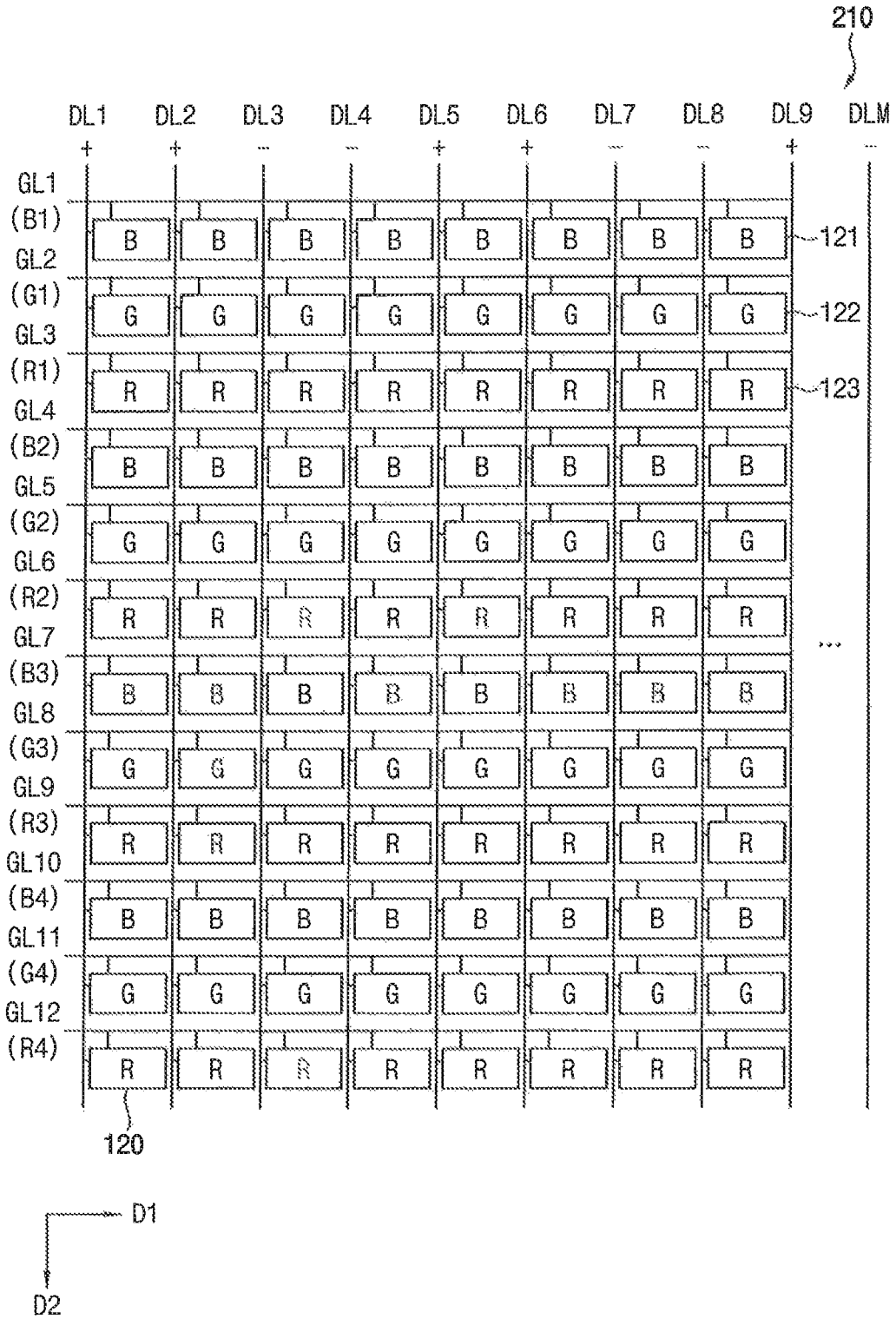
FIGS. 11A and 11B are plan views illustrating an operation of the display panel of FIGS. 9A and 9B in which a plurality of data signals generated based on a positive polarity and a negative polarity are applied to a plurality of data lines according to an exemplary embodiment of the inventive concept.
Figure 11B:
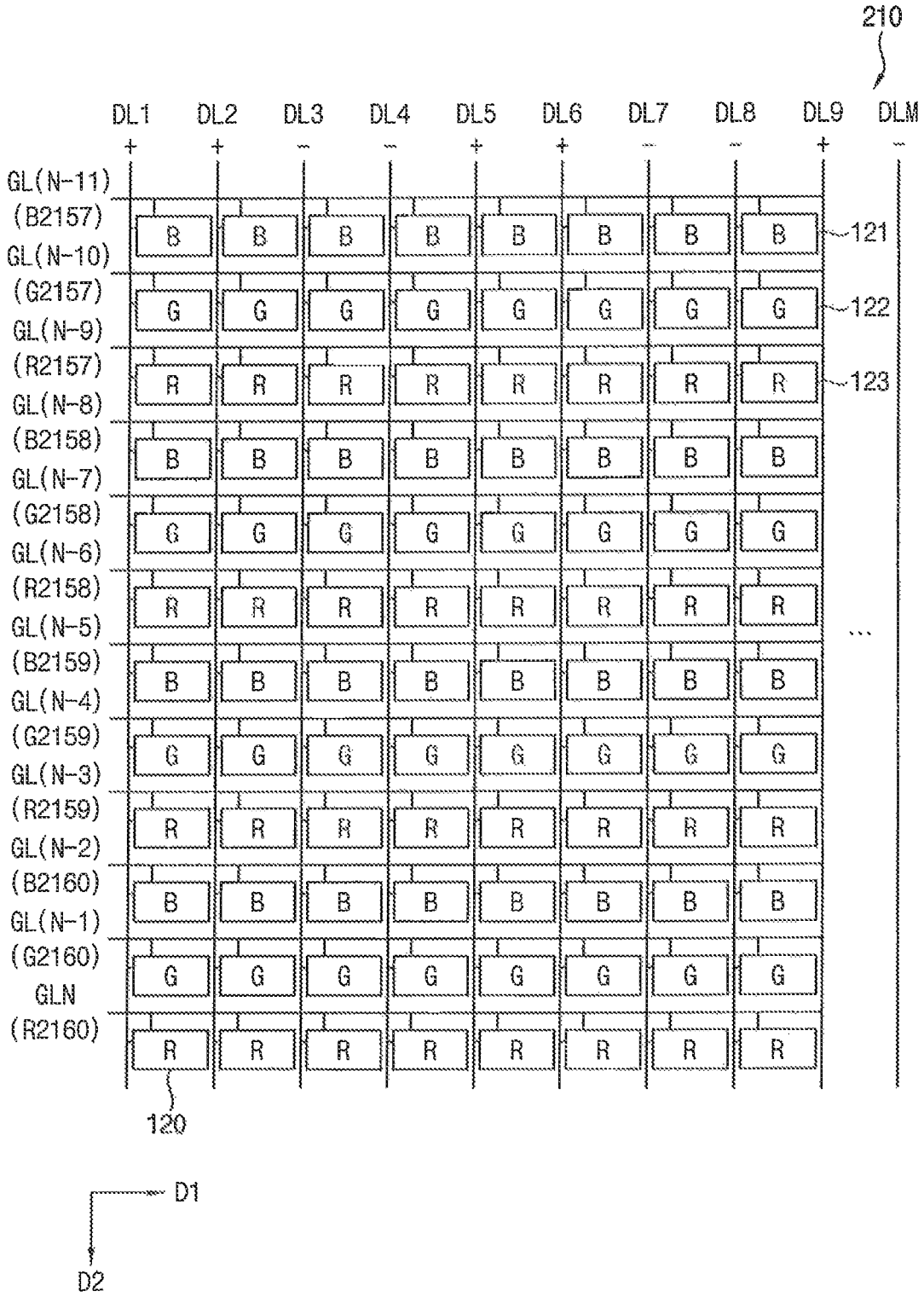

FIGS. 11A and 11B are plan views illustrating an operation of the display panel of FIGS. 9A and 9B in which a plurality of data signals generated based on a positive polarity and a negative polarity are applied to a plurality of data lines according to an exemplary embodiment of the inventive concept.

Referring to FIGS. 1, 5, 11A, and 11B, the display panel 210 may be driven by the gate driving circuit 130 and the data driving circuit 140. The operation of the gate driving circuit 130 and the data driving circuit 140 may be substantially the same as the operation described with reference to FIG. 5.

The gate driving circuit 130 sequentially drives K-th, (K+2)-th, (K+4)-th, (K+12)-th, (K+14)-th, (K+16)-th, (K+24)-th, . . . , (N−11)-th, (N−9)-th, and (N−7)-th gate lines during the first subframe period SF1, sequentially drives (K+6)-th, (K+8)-th, (K+10)-th, (K+18)-th, (K+20)-th, (K+22)-th, (K+30)-th, . . . , (N−5)-th, (N−3)-th, and (N−1)-th gate lines during the second subframe period SF2, sequentially drives (K+1)-th, (K+3)-th, (K+5)-th, (K+13)-th, (K+15)-th, (K+17)-th, (K+25)-th, . . . , (N−10)-th, (N−8)-th, and (N−6)-th gate lines during the third subframe period SF3, and sequentially drives (K+7)-th, (K+9)-th, (K+11)-th, (K+19)-th, (K+21)-th, (K+23)-th, (K+31)-th, . . . , (N−4)-th, (N−2)-th, and N-th gate lines during the fourth subframe period SF4, where K is a natural number less than N.

The plurality of data signals DS are reversed in polarity for every two data lines in the first direction D1. For example, during the first subframe period SF1, the data driving circuit 140 may output a data signal having a positive polarity (+) to the first data line DL1, may output a data signal having the positive polarity (+) to the second data line DL2, may output a data signal having a negative polarity (−) opposite to the positive polarity (+) to the third data line DL3, and may output a data signal having the negative polarity (−) to the fourth data line DL4. Similarly, the data driving circuit 140 may output a data signal having the positive polarity (+) to the fifth data line DL5, may output a data signal having the positive polarity (+) to the sixth data line DL6, may output a data signal having the negative polarity (−) to the seventh data line DL7, and may output a data signal having the negative polarity (−) to the eighth data line DL8. As described above, the positive polarity (+) may be referred to as the first polarity, and the negative polarity (−) may be referred to as the second polarity.

In addition, the plurality of data signals DS are reversed in polarity for every subframe. For example, for a single data line, the data driving circuit 140 may output first data signals having the positive polarity (+) during the first subframe period SF1, may output second data signals having the negative polarity (−) during the second subframe period SF2, may output third data signals having the positive polarity (+) during the third subframe period SF3, and may output fourth data signals having the negative polarity (−) during the fourth subframe period SF4.

Figure 12A:
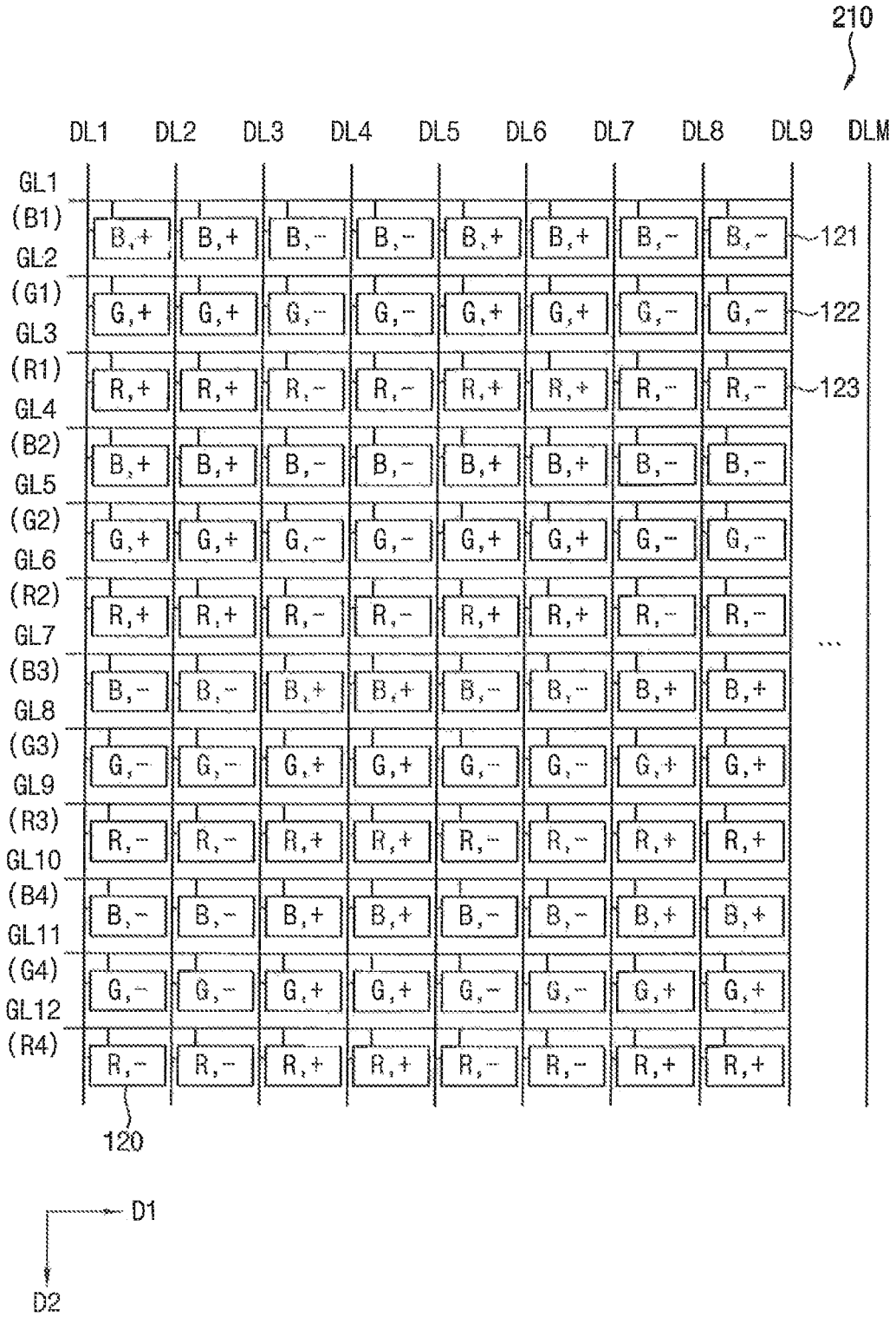
FIGS. 12A and 12B are plan views illustrating an operation of the display panel of FIGS. 9A and 9B in which a plurality of data signals generated based on a positive polarity and a negative polarity are applied to a plurality of pixels according to an exemplary embodiment of the inventive concept.
Figure 12B:
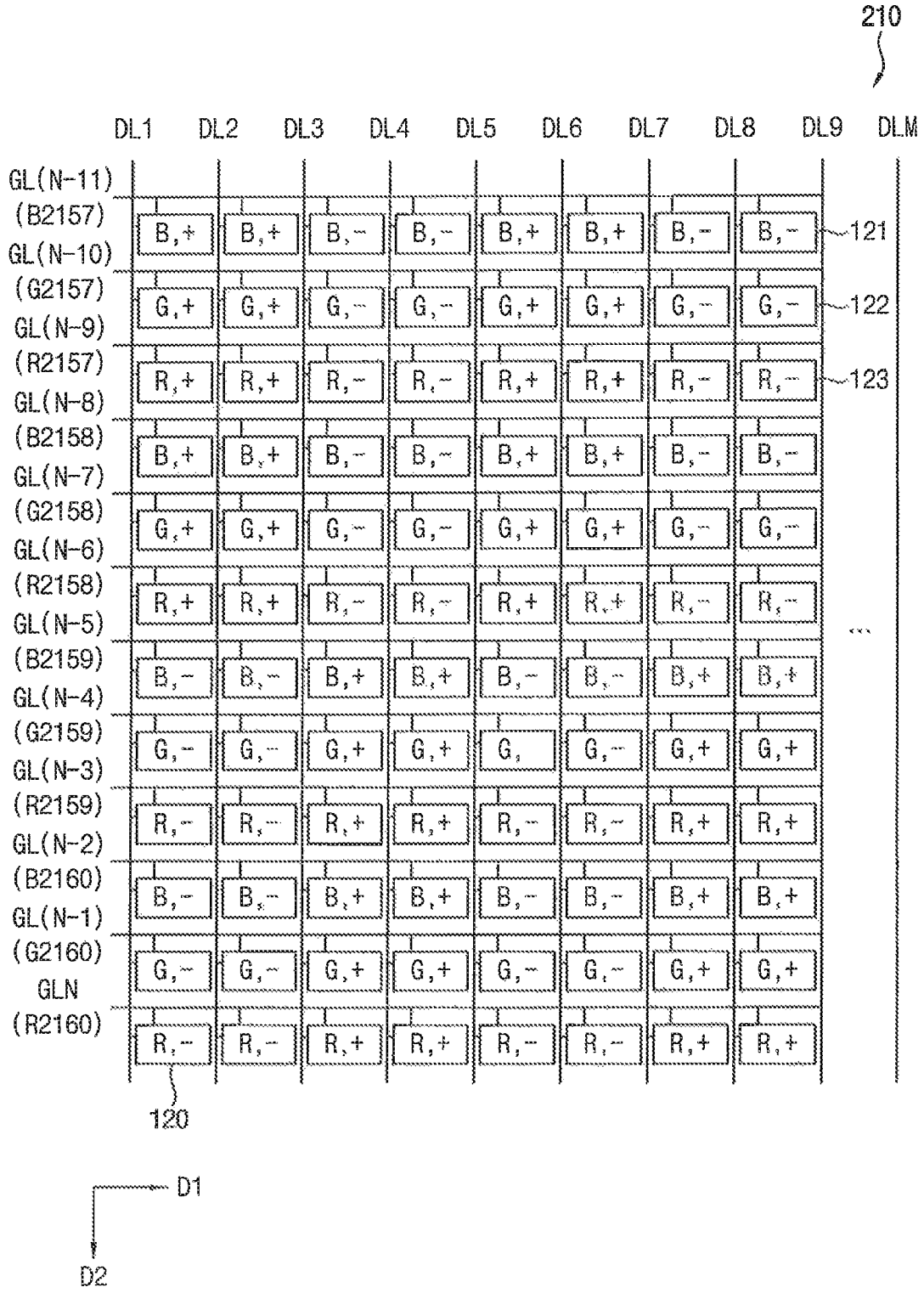

FIGS. 12A and 12B are plan views illustrating an operation of the display panel of FIGS. 9A and 9B in which a plurality of data signals generated based on a positive polarity and a negative polarity are applied to a plurality of pixels according to an exemplary embodiment of the inventive concept.

Referring to FIGS. 1, 5, 11A, 11B, 12A, and 12B, based on the operations of the gate driving circuit 130 and the data driving circuit 140, the plurality of pixels 120 are reversed in polarity for every two pixels in the first direction D1 and for every six pixels in the second direction D2.

Figure 13A:
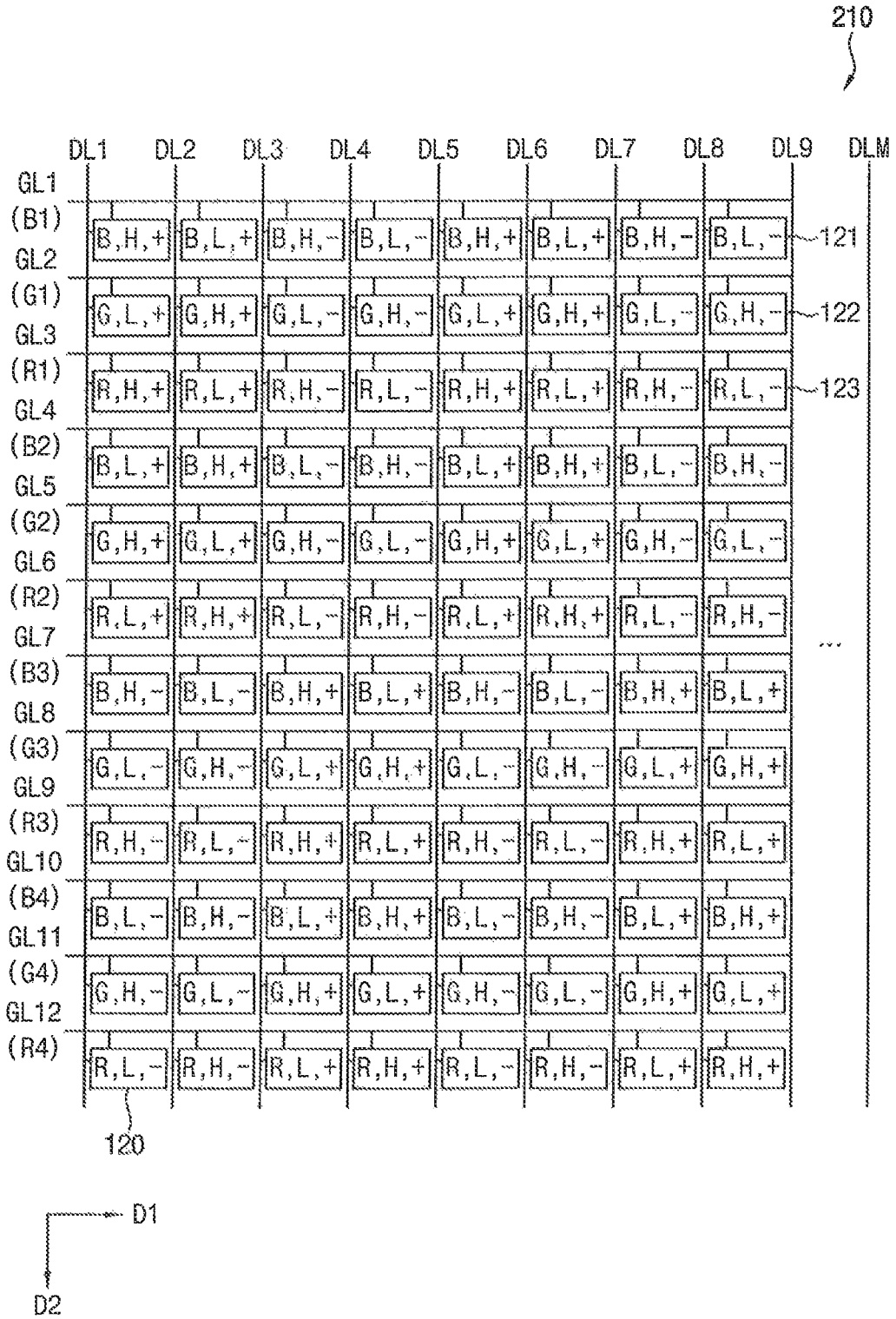
FIGS. 13A and 13B are plan views illustrating an operation of the display panel of FIGS. 9A and 9B in which a plurality of data signals generated based on high and low gamma voltages and positive and negative polarities are applied to a plurality of pixels according to an exemplary embodiment of the inventive concept.
Figure 13B:
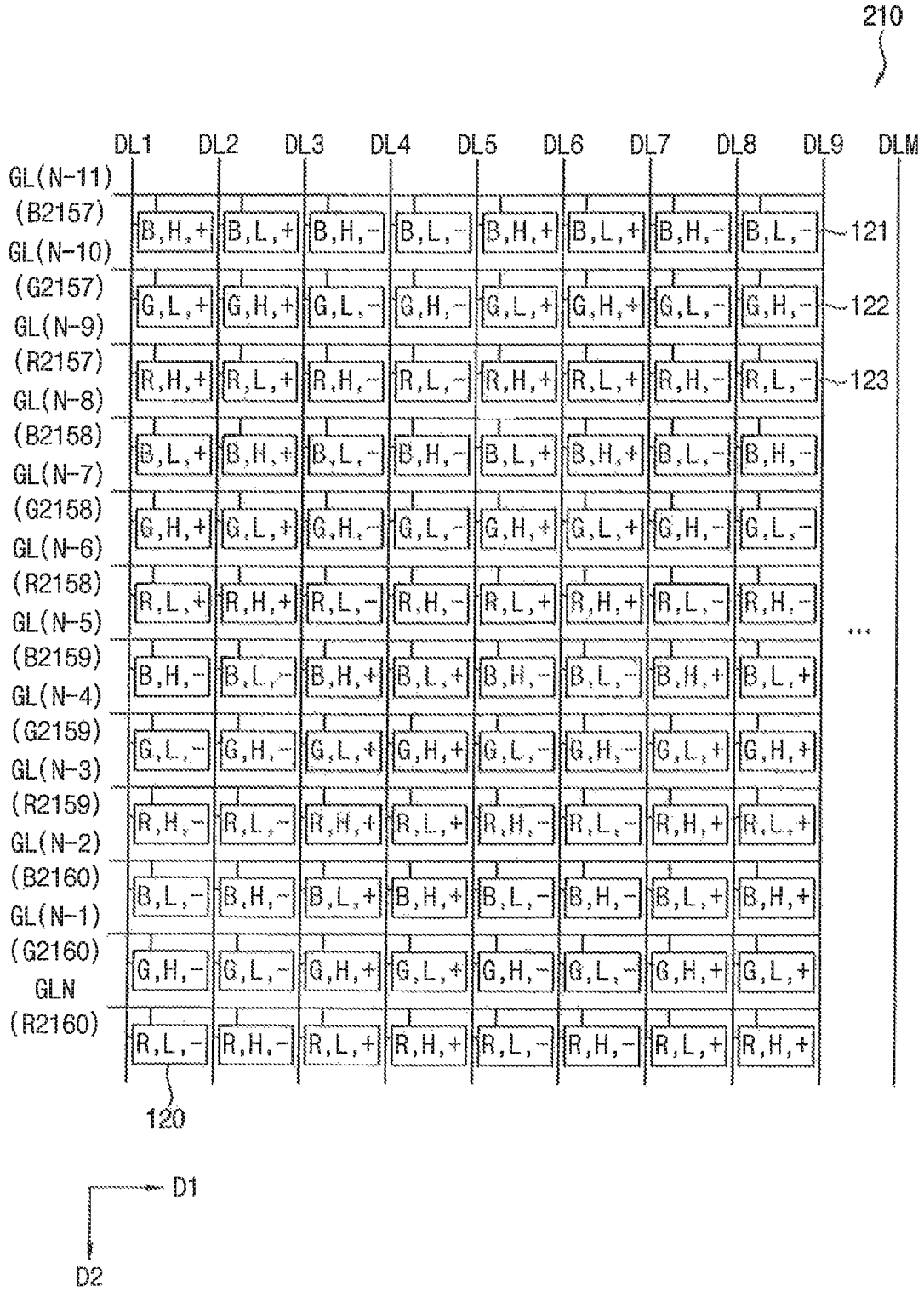

FIGS. 13A and 13B are plan views illustrating an operation of the display panel of FIGS. 9A and 9B in which a plurality of data signals generated based on high and low gamma voltages and positive and negative polarities are applied to a plurality of pixels according to an exemplary embodiment of the inventive concept.

Referring to FIGS. 1, 5, 9A, 9B, 10A, 10B, 11A, 11B, 12A, 12B, 13A, and 13B, based on the operation of the data driving circuit 140, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2.

Based on the operations of the gate driving circuit 130 and the data driving circuit 140, the plurality of pixels 120 are reversed in polarity for every two pixels in the first direction D1 and for every six pixels in the second direction D2.

A method of driving the display apparatus including the display panel 210 may be substantially the same as the method described with reference to FIG. 8.

In the display apparatus 100 according to an exemplary embodiment of the inventive concept, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2, and thus the display apparatus 100 may have a relatively improved visibility from the side. In addition, in the pixels having the same color, the data signals are reversed in polarity in the first and second directions D1 and D2, and thus a moving horizontal spot and/or a moving vertical spot may be prevented. Accordingly, the display apparatus 100 may have a relatively improved display quality.

Figure 14A:
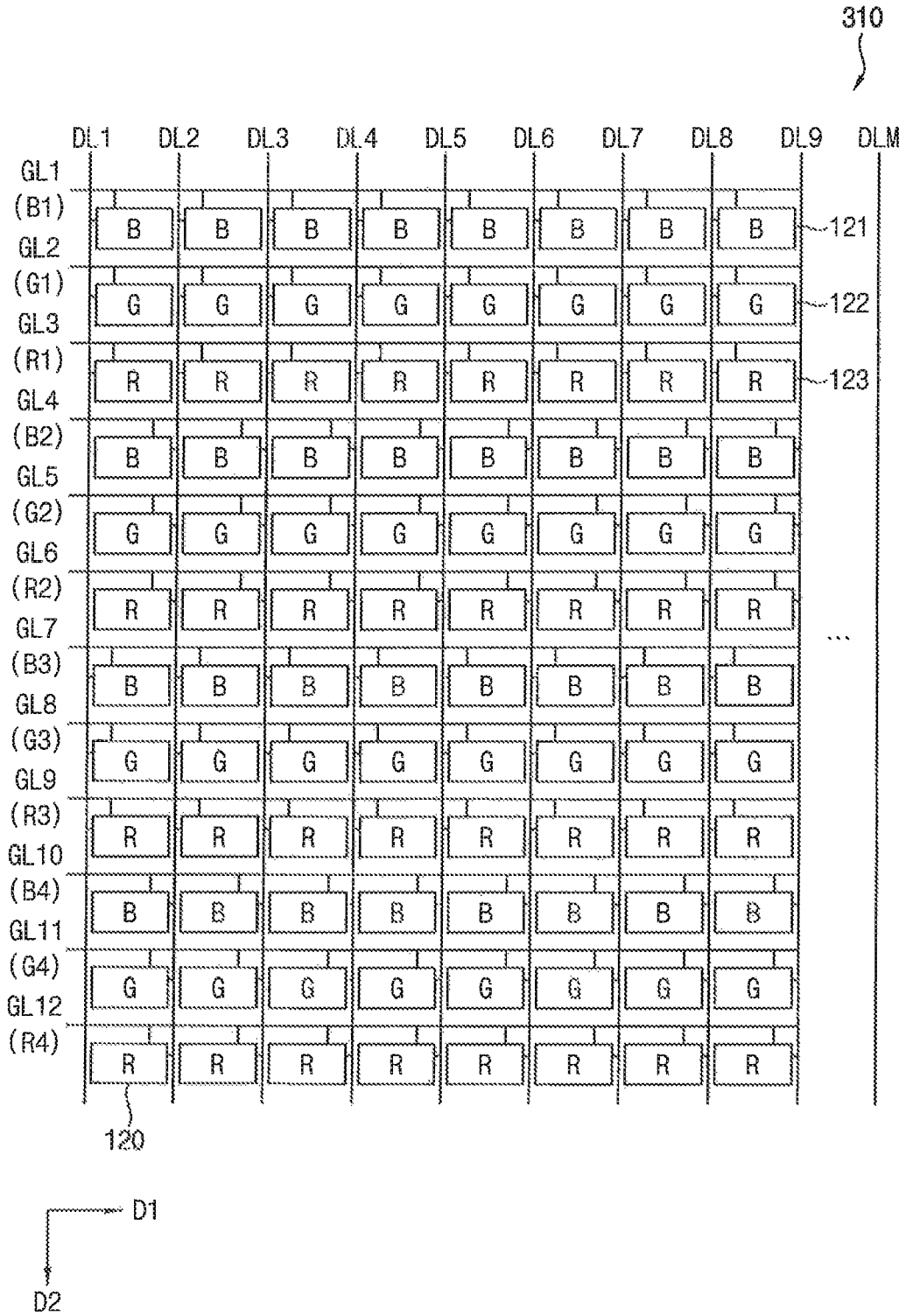
FIGS. 14A and 14B are plan views illustrating a display panel included in the display apparatus of FIG. 1 according to an exemplary embodiment of the inventive concept.
Figure 14B:
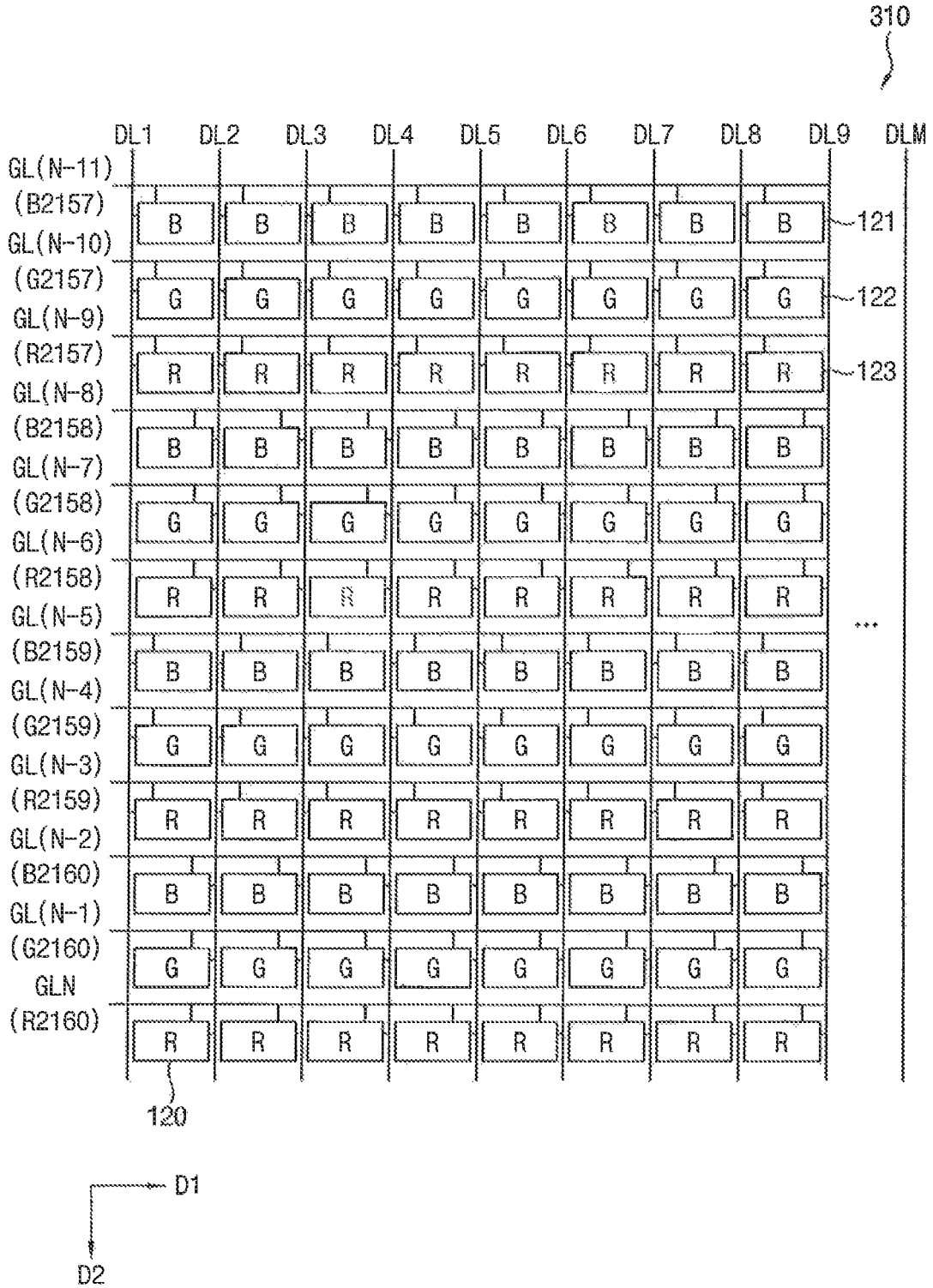

FIGS. 14A and 14B are plan views illustrating a display panel included in the display apparatus of FIG. 1 according to an exemplary embodiment of the inventive concept.

A display panel 310 illustrated in FIGS. 14A and 14B may be included in the display apparatus 100 of FIG. 1. In other words, a display apparatus including the display panel 310 of FIGS. 14A and 14B may be substantially the same as the display apparatus including the display panel 110 of FIGS. 2A and 2B, except that the display panel 110 is replaced with the display panel 310. Like reference numerals refer to like elements, and repeat descriptions are omitted.

Referring to FIGS. 1, 14A, and 14B, the display panel 310 includes first through N-th gate lines GL1, GL2, . . . , GLN and first through M-th data lines DL1, DL2, . . . , DLM, where N is a natural number greater than or equal to 48 and M is a natural number greater than or equal to 4. The display panel 310 includes the plurality of pixels 120 each of which is connected to a respective one of the first through N-th gate lines GL1, GL2, . . . , GLN and a respective one of the first through M-th data lines DL1, DL2, . . . , DLM. The first through N-th gate lines GL1, GL2, . . . , GLN may be included in the plurality of gate lines GL in FIG. 1, and the first through M-th data lines DL1, DL2, . . . , DLM may be included in the plurality of data lines DL in FIG. 1.

The plurality of pixels 120 may include the plurality of first color pixels 121, the plurality of second color pixels 122, and the plurality of third color pixels 123. The plurality of first color pixels 121 may be arranged in the first direction D1. The plurality of second color pixels 122 may be arranged at a first side (e.g., a bottom side) with respect to the plurality of first color pixels 121, and may be arranged in the first direction D1. The plurality of third color pixels 123 may be arranged at the first side with respect to the plurality of second color pixels 122, and arranged in the first direction D1. For example, the plurality of first color pixels 121 may include blue pixels B, the plurality of second color pixels 122 may include green pixels G, and the plurality of third color pixels 123 may include red pixels R. The plurality of first, second, and third color pixels 121, 122, and 123 may be repeated in the second direction D2.

Each of the first through M-th data lines DL1, DL2, . . . , DLM may be, alternately for every three pixels in the second direction D2, connected to some of the plurality of pixels 120 at both sides (e.g., left and right sides) thereof.

For example, the second data line DL2 may be connected to blue, green, and red pixels in first, second, and third pixel rows and a second pixel column on the right side, connected to blue, green, and red pixels in fourth, fifth, and sixth pixel rows and a first pixel column on the left side, connected to blue, green, and red pixels in seventh, eighth, and ninth pixel rows and the second pixel column, connected to blue, green, and red pixels in tenth, eleventh, and twelfth pixel rows and the first pixel column, etc.

Figure 15A:
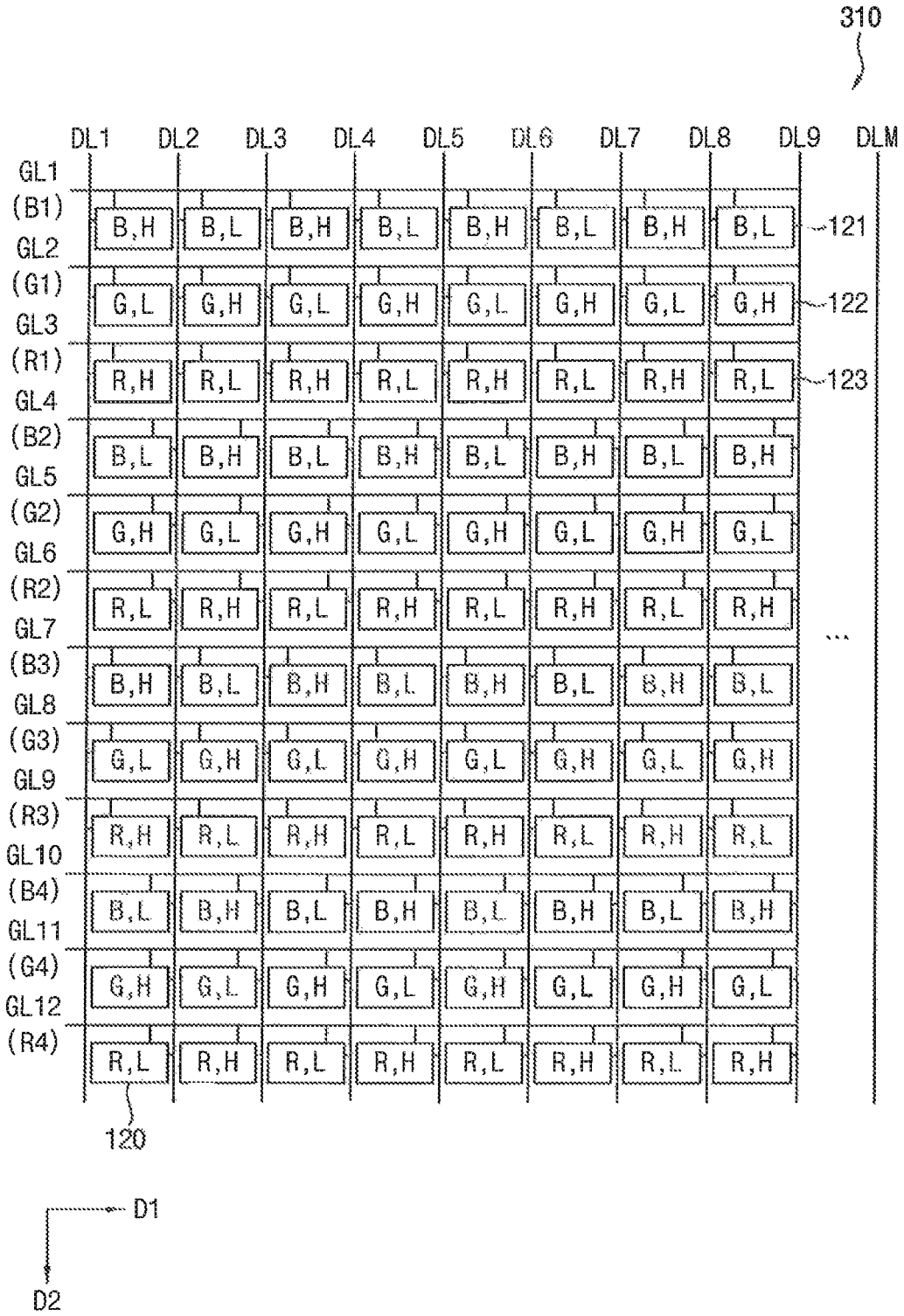
FIGS. 15A and 15B are plan views illustrating an operation of the display panel of FIGS. 14A and 14B in which a plurality of data signals generated based on a high gamma voltage and a low gamma voltage are applied to a plurality of pixels according to an exemplary embodiment of the inventive concept.
Figure 15B:
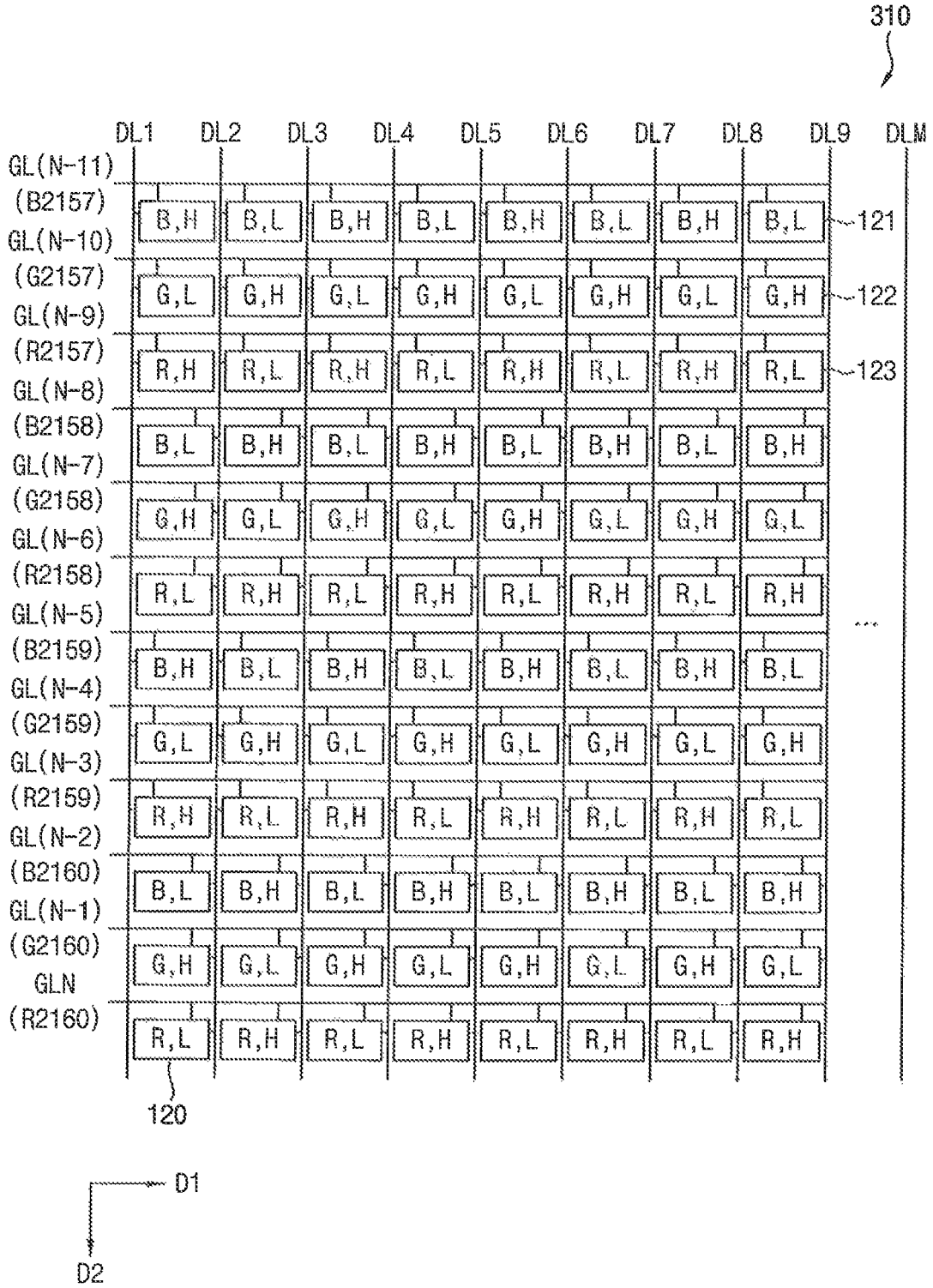

FIGS. 15A and 15B are plan views illustrating an operation of the display panel of FIGS. 14A and 14B in which a plurality of data signals generated based on a high gamma voltage and a low gamma voltage are applied to a plurality of pixels according to an exemplary embodiment of the inventive concept.

Referring to FIGS. 1, 15A, and 15B, the data driving circuit 140 receives the high gamma voltage HGV and the low gamma voltage LGV from the gamma voltage generating circuit 160. The data driving circuit 140 generates some of the plurality of data signals DS based on the high gamma voltage HGV and the other of the plurality of data signals DS based on the low gamma voltage LGV. The data driving circuit 140, alternately for every pixel in the first direction D1, applies the high gamma data voltage H based on the high gamma voltage HGV and the low gamma data voltage L based on the low gamma voltage LGV to the plurality of pixels 120. In addition, the data driving circuit 140, alternately for every pixel in the second direction D2, applies the high gamma data voltage H based on the high gamma voltage HGV and the low gamma data voltage L based on the low gamma voltage LGV to the plurality of pixels 120. Thus, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2. In other words, the high and low gamma data voltages H and L are, alternately for every pixel in the first and second directions D1 and D2, charged to the plurality of pixels 120.

Figure 16A:
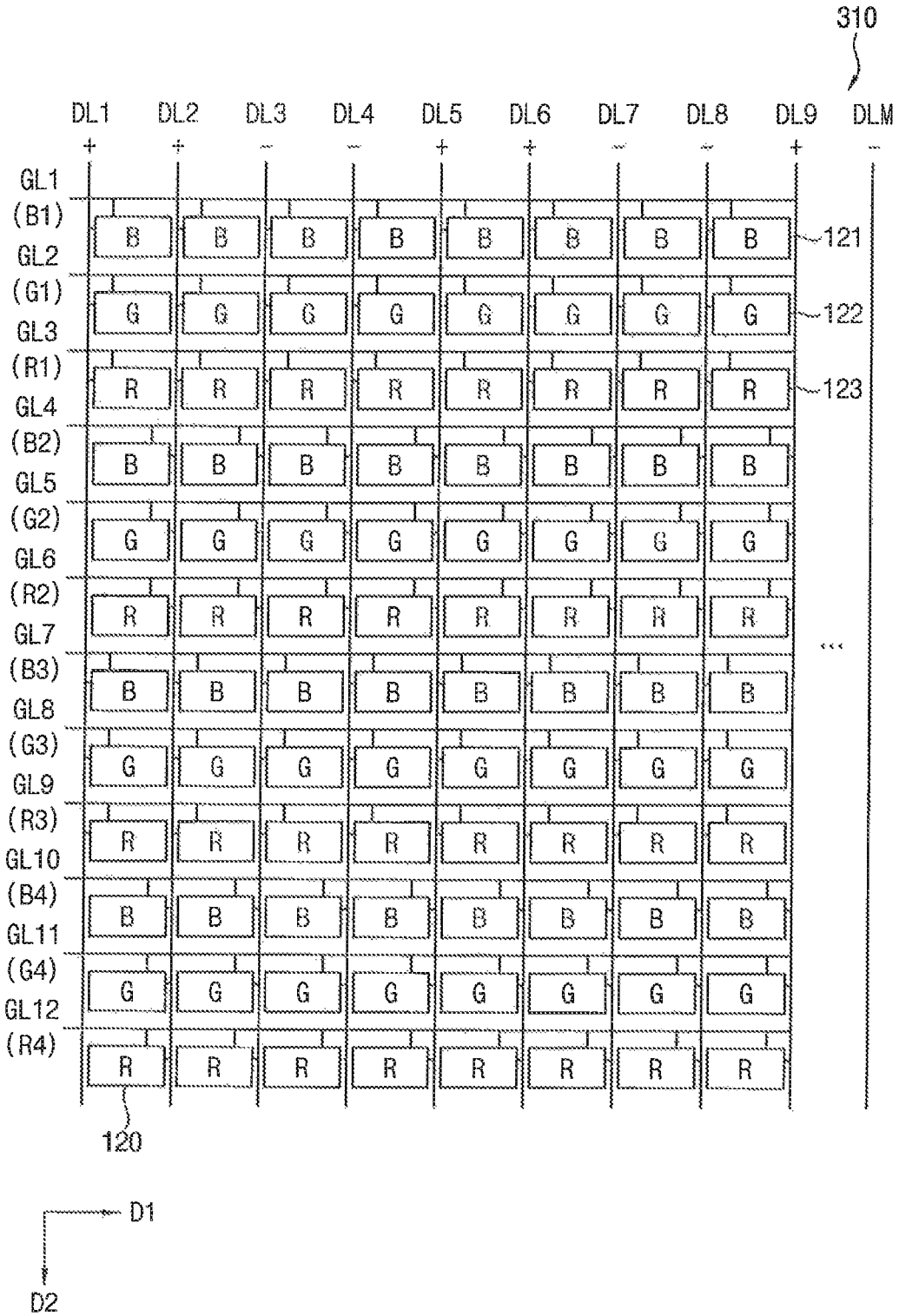
FIGS. 16A and 16B are plan views illustrating an operation of the display panel of FIGS. 14A and 14B in which a plurality of data signals generated based on a positive polarity and a negative polarity are applied to a plurality of data lines according to an exemplary embodiment of the inventive concept.
Figure 16B:
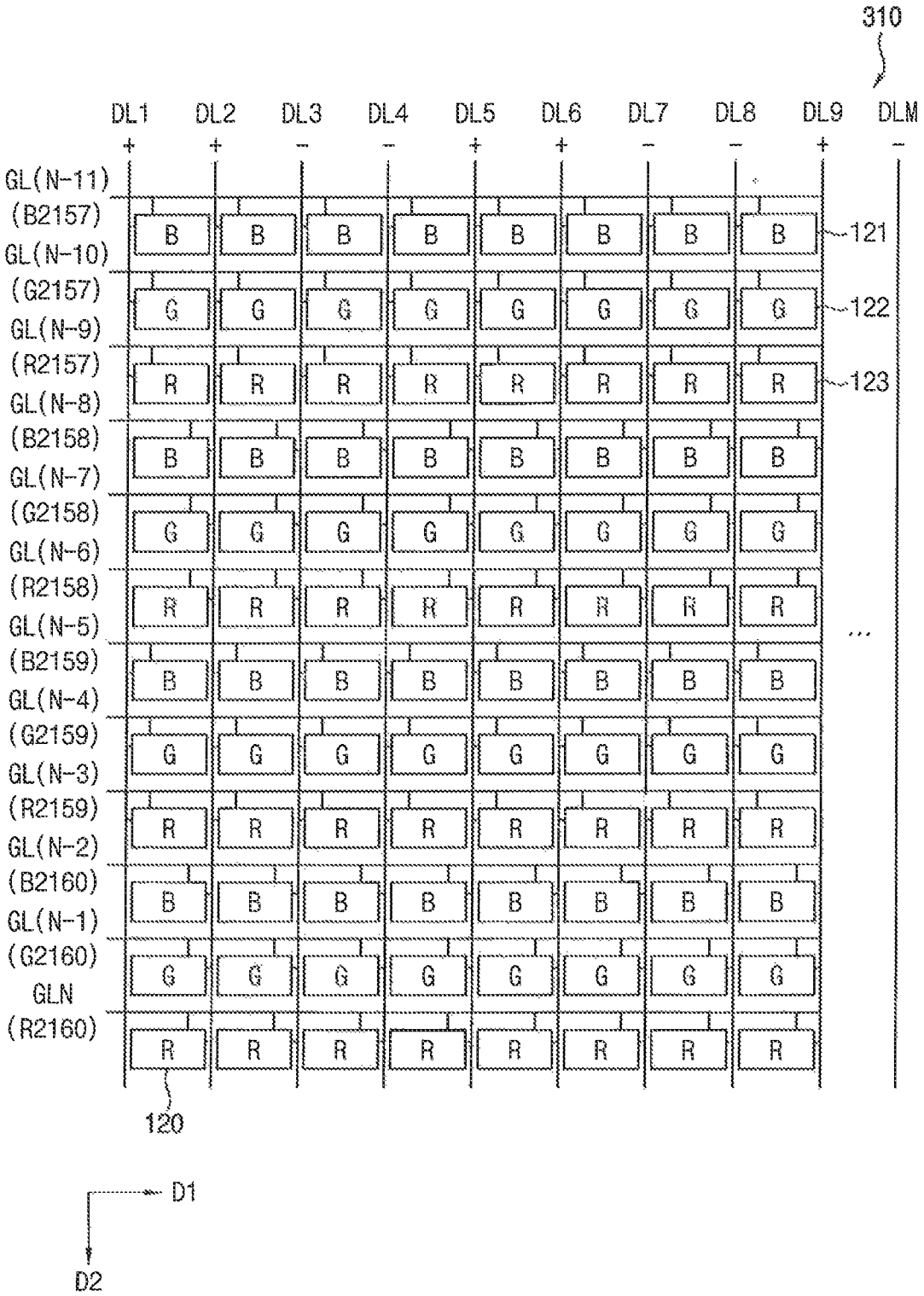

FIGS. 16A and 16B are plan views illustrating an operation of the display panel of FIGS. 14A and 14B in which a plurality of data signals generated based on a positive polarity and a negative polarity are applied to a plurality of data lines according to an exemplary embodiment of the inventive concept.

Referring to FIGS. 1, 5, 16A, and 16B, the display panel 310 may be driven by the gate driving circuit 130 and the data driving circuit 140. The operation of the gate driving circuit 130 and the data driving circuit 140 may be substantially the same as the operation described with reference to FIG. 5.

The gate driving circuit 130 sequentially drives K-th, (K+2)-th, (K+4)-th, (K+12)-th, (K+14)-th, (K+16)-th, (K+24)-th, . . . , (N−11)-th, (N−9)-th, and (N−7)-th gate lines during the first subframe period SF1, sequentially drives (K+6)-th, (K+8)-th, (K+10)-th, (K+18)-th, (K+20)-th, (K+22)-th, (K+30)-th, . . . , (N−5)-th, (N−3)-th, and (N−1)-th gate lines during the second subframe period SF2, sequentially drives (K+1)-th, (K+3)-th, (K+5)-th, (K+13)-th, (K+15)-th, (K+17)-th, (K+25)-th, . . . , (N−10)-th, (N−8)-th, and (N−6)-th gate lines during the third subframe period SF3, and sequentially drives (K+7)-th, (K+9)-th, (K+11)-th, (K+19)-th, (K+21)-th, (K+23)-th, (K+31)-th, . . . , (N−4)-th, (N−2)-th, and N-th gate lines during the fourth subframe period SF4, where K is a natural number less than N.

The plurality of data signals DS are reversed in polarity for every two data lines in the first direction D1. For example, during the first subframe period SF1, the data driving circuit 140 may output a data signal having the positive polarity (+) to the first data line DL1, may output a data signal having the positive polarity (+) to the second data line DL2, may output a data signal having the negative polarity (−) opposite to the positive polarity (+) to the third data line DL3, and may output a data signal having the negative polarity (−) to the fourth data line DL4. Similarly, the data driving circuit 140 may output a data signal having the positive polarity (+) to the fifth data line DL5, may output a data signal having the positive polarity (+) to the sixth data line DL6, may output a data signal having the negative polarity (−) to the seventh data line DL7, and may output a data signal having the negative polarity (−) to the eighth data line DL8. As described above, the positive polarity (+) may be referred to as the first polarity, and the negative polarity (−) may be referred to as the second polarity.

In addition, the plurality of data signals DS are reversed in polarity for every subframe. For example, for a single data line, the data driving circuit 140 may output first data signals having the positive polarity (+) during the first subframe period SF1, may output second data signals having the negative polarity (−) during the second subframe period SF2, may output third data signals having the positive polarity (+) during the third subframe period SF3, and may output fourth data signals having the negative polarity (−) during the fourth subframe period SF4.

Figure 17A:
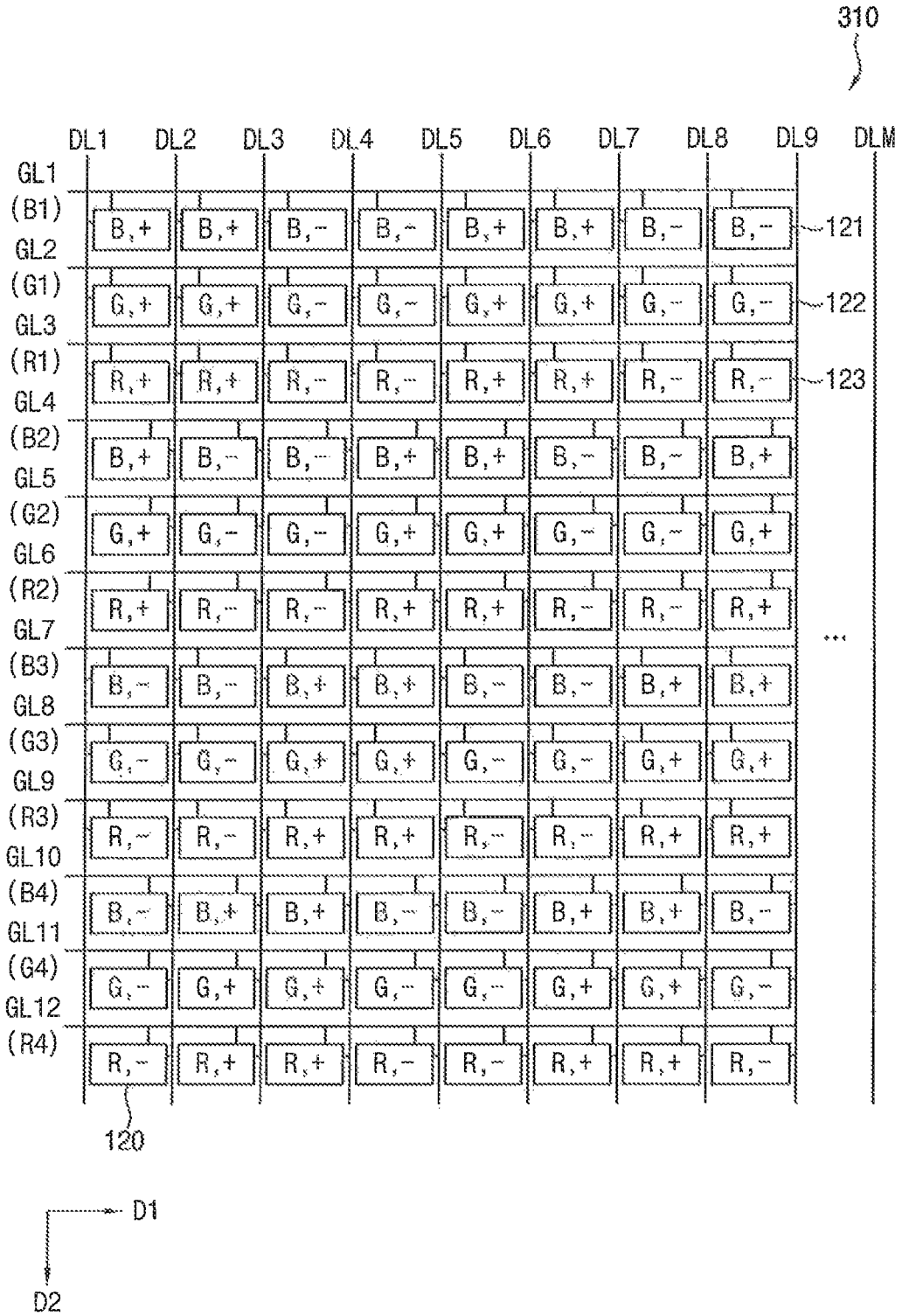
FIGS. 17A and 17B are plan views illustrating an operation of the display panel of FIGS. 14A and 14B in which a plurality of data signals generated based on a positive polarity and a negative polarity are applied to a plurality of pixels according to an exemplary embodiment of the inventive concept.
Figure 17B:
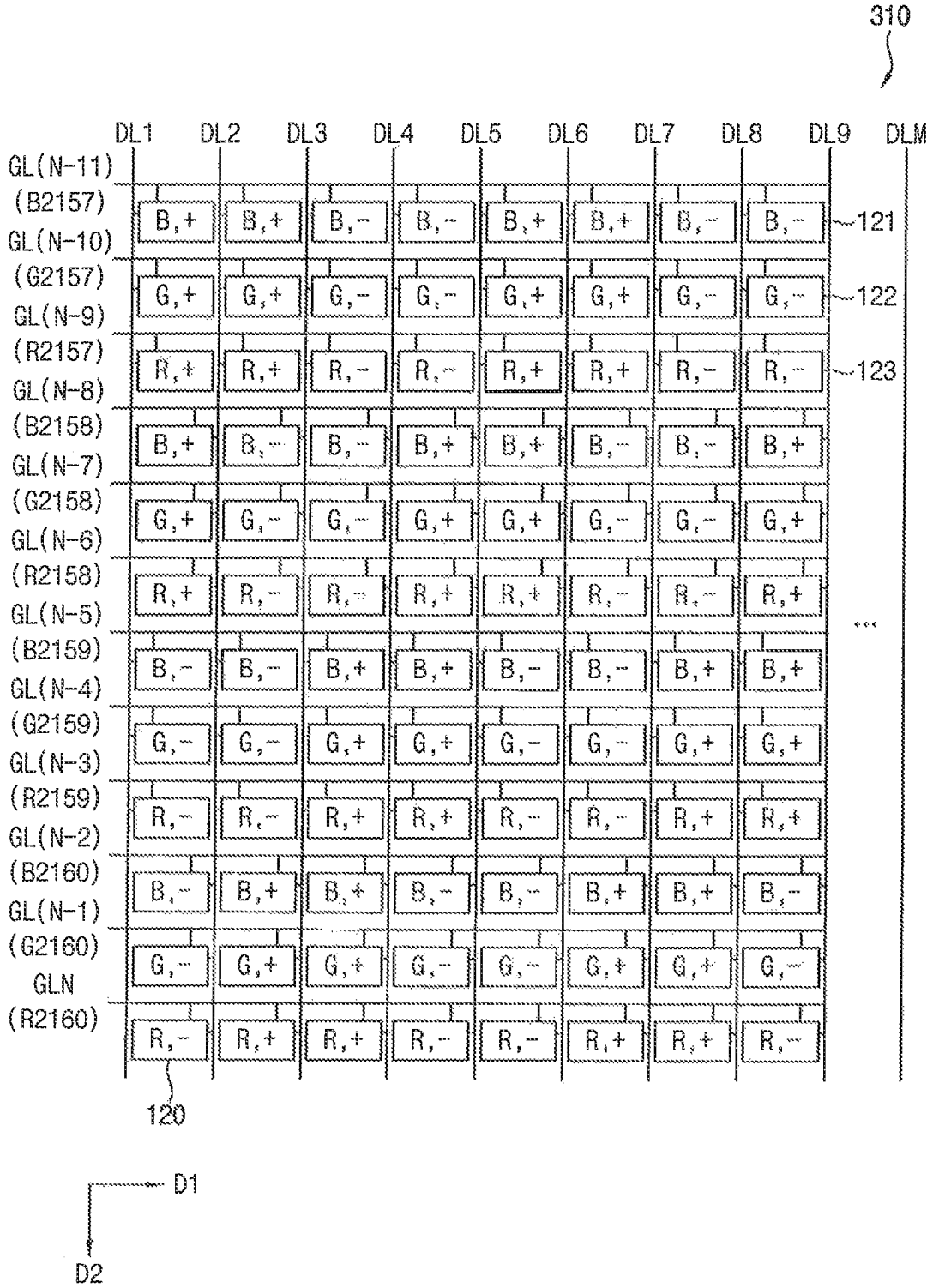

FIGS. 17A and 17B are plan views illustrating an operation of the display panel of FIGS. 14A and 14B in which a plurality of data signals generated based on a positive polarity and a negative polarity are applied to a plurality of pixels according to an exemplary embodiment of the inventive concept.

Referring to FIGS. 1, 5, 16A, 16B, 17A, and 17B, based on the operations of the gate driving circuit 130 and the data driving circuit 140, the plurality of pixels 120 are reversed in polarity for every two pixels in the first direction D1 and for every six pixels in the second direction D2.

Figure 18A:
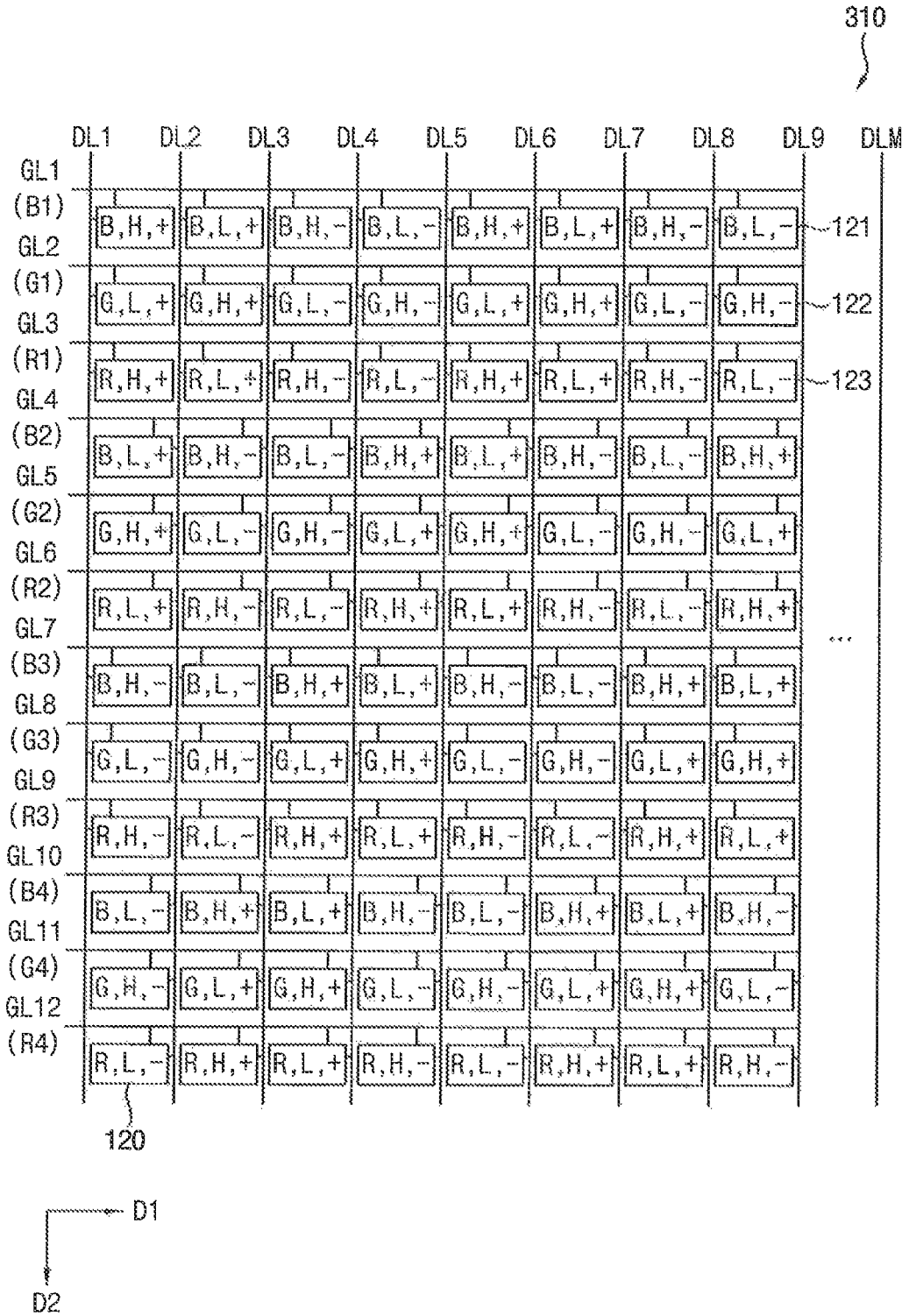
FIGS. 18A and 18B are plan views illustrating an operation of the display panel of FIGS. 14A and 14B in which a plurality of data signals generated based on high and low gamma voltages and positive and negative polarities are applied to a plurality of pixels according to an exemplary embodiment of the inventive concept.
Figure 18B:
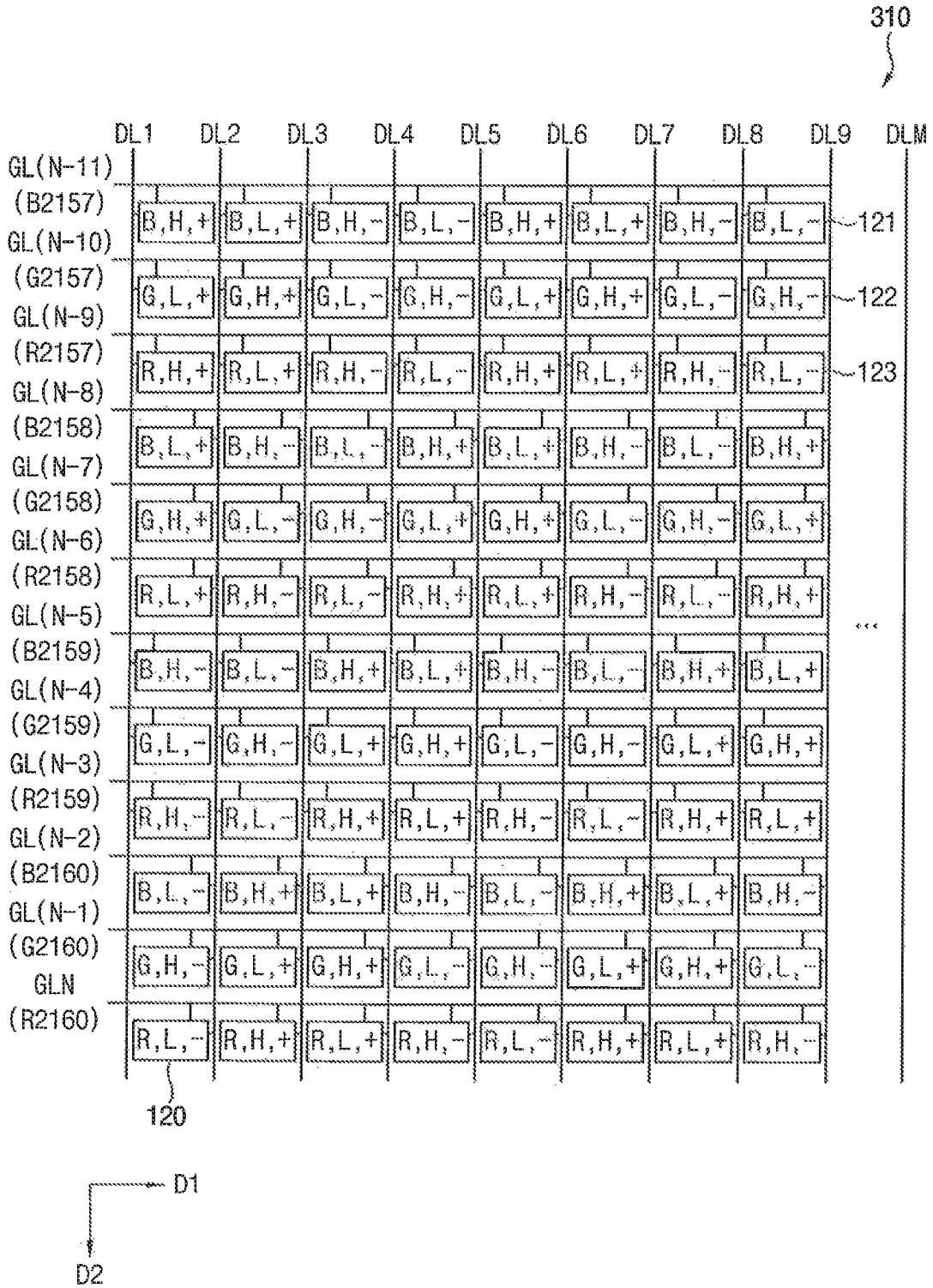

FIGS. 18A and 18B are plan views illustrating an operation of the display panel of FIGS. 14A and 14B in which a plurality of data signals generated based on high and low gamma voltages and positive and negative polarities are applied to a plurality of pixels according to an exemplary embodiment of the inventive concept.

Referring to FIGS. 1, 5, 14A, 14B, 15A, 15B, 16A, 16B, 17A, 17B, 18A, and 18B, based on the operation of the data driving circuit 140, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2.

Based on the operations of the gate driving circuit 130 and the data driving circuit 140, the plurality of pixels 120 are reversed in polarity for every two pixels in the first direction D1 and for every six pixels in the second direction D2.

A method of driving the display apparatus including the display panel 310 may be substantially the same as the method described with reference to FIG. 8.

In the display apparatus 100 according to an exemplary embodiment of the inventive concept, the plurality of pixels 120 has a gamma pattern in which the high gamma data voltage H based on the high gamma voltage HGV and the low gamma data voltage L based on the low gamma voltage LGV are alternately arranged for every row and column in the first and second directions D1 and D2, and thus the display apparatus 100 may have a relatively improved visibility from the side. In addition, in the pixels having the same color, the data signals are reversed in polarity in the first and second directions D1 and D2, and thus a moving horizontal spot and/or a moving vertical spot may be prevented. Accordingly, the display apparatus 100 may have a relatively improved display quality.

The above described exemplary embodiments of the inventive concept may be used in a display apparatus and/or a system including the display apparatus, such as a mobile phone, a smart phone, a personal digital assistant (PDA), a portable multimedia player (PMP), a digital camera, a digital television, a set-top box, a music player, a portable game console, a navigation device, a personal computer (PC), a server computer, a workstation, a tablet computer, a laptop computer, etc.

As described above, in the display apparatus and the method of driving the display apparatus according to exemplary embodiments of the inventive concept, the plurality of pixels has a gamma pattern in which the high gamma data voltage and the low gamma data voltage are alternately arranged for every row and column in first and second directions, and thus the display apparatus may have a relatively improved visibility from the side. In addition, the plurality of pixels are reversed in polarity for every two pixels in the first direction and for every six pixels in the second direction, and thus the degradation of liquid crystal included in the display panel may be prevented. Accordingly, the display apparatus may have a relatively improved display quality.

While the inventive concept has been shown and described above with reference to exemplary embodiments thereof, it will be apparent to those of ordinary skill in the art that various changes in form and details may be made thereto without departing from the spirit and scope of the inventive concept, as set forth by the following claims.

What is claimed is:

1. A display apparatus comprising:

a display panel configured to display an image, and including N gate lines extending in a first direction, M data lines extending in a second direction substantially perpendicular to the first direction, and a plurality of pixels each of which is connected to a respective one of the N gate lines and a respective one of the M data lines, wherein N is a natural number greater than or equal to 48 and M is a natural number greater than or equal to 4;

a gate driving circuit configured to sequentially drive K-th, (K+2)-th, (K+4)-th, (K+12)-th, (K+14)-th, (K+16)-th, (K+24)-th, . . . , (N−11)-th, (N−9)-th, and (N−7)-th gate lines during a first subframe period, configured to sequentially drive (K+6)-th, (K+8)-th, (K+10)-th, (K+18)-th, (K+20)-th, (K+22)-th, (K+30)-th, . . . , (N−5)-th, (N−3)-th, and (N−1)-th gate lines during a second subframe period subsequent to the first subframe period, configured to sequentially drive (K+1)-th, (K+3)-th, (K+5)-th, (K+13)-th, (K+15)-th, (K+17)-th, (K+25)-th, . . . , (N−10)-th, (N−8)-th, and (N−6)-th gate lines during a third subframe period subsequent to the second subframe period, and configured to sequentially drive (K+7)-th, (K+9)-th, (K+11)-th, (K+19)-th, (K+21)-th, (K+23)-th, (K+31)-th, . . . , (N−4)-th, (N−2)-th, and N-th gate lines during a fourth subframe period subsequent to the third subframe period, wherein K is a natural number less than N; and a data driving circuit configured to drive the M data lines by outputting a plurality of data signals to the M data lines.

2. The display apparatus of claim 1, wherein each of the M data lines includes a first side and a second side along the second direction, and each of the M data lines is connected to some of the plurality of pixels alternately at the first side and the second side.

3. The display apparatus of claim 2, wherein the data driving circuit is configured to output first data signals having a first polarity during the first subframe period, configured to output second data signals having a second polarity opposite to the first polarity during the second subframe period, configured to output third data signals having the first polarity during the third subframe period, and configured to output fourth data signals having the second polarity during the fourth subframe period.

4. The display apparatus of claim 3, wherein the plurality of data signals are reversed in polarity for every two data lines in the first direction.

5. The display apparatus of claim 4, wherein each of the plurality of data signals is generated using one of a high gamma voltage and a low gamma voltage, and the plurality of pixels has a gamma pattern in which a high gamma data voltage based on the high gamma voltage and a low gamma data voltage based on the low gamma voltage are alternately arranged for every row and column in the first and second directions.

6. The display apparatus of claim 1, wherein each of the M data lines includes a first side along the second direction, and each of the M data lines is connected to some of the plurality of pixels at the first side.

7. The display apparatus of claim 6, wherein the data driving circuit is configured to output first data signals having a first polarity during the first subframe period, configured to output second data signals having a second polarity opposite to the first polarity during the second subframe period, configured to output third data signals having the first polarity during the third subframe period, and configured to output fourth data signals having the second polarity during the fourth subframe period.

8. The display apparatus of claim 7, wherein the plurality of data signals are reversed in polarity for every two data lines in the first direction.

9. The display apparatus of claim 8, wherein each of the plurality of data signals is generated using one of a high gamma voltage and a low gamma voltage, and the plurality of pixels has a gamma pattern in which a high gamma data voltage based on the high gamma voltage and a low gamma data voltage based on the low gamma voltage are alternately arranged for every row and column in the first and second directions.

10. The display apparatus of claim 1, wherein each of the M data lines includes a first side and a second side along the second direction, and each of the M data lines is connected to some of the plurality of pixels, alternately for every three pixels, at the first side and the second side.

11. The display apparatus of claim 10, wherein the data driving circuit is configured to output first data signals having a first polarity during the first subframe period, configured to output second data signals having a second polarity opposite to the first polarity during the second subframe period, configured to output third data signals having the first polarity during the third subframe period, and configured to output fourth data signals having the second polarity during the fourth subframe period.

12. The display apparatus of claim 11, wherein the plurality of data signals are reversed in polarity for every two data lines in the first direction.

13. The display apparatus of claim 12, wherein each of the plurality of data signals is generated using one of a high gamma voltage and a low gamma voltage, and the plurality of pixels has a gamma pattern in which a high gamma data voltage based on the high gamma voltage and a low gamma data voltage based on the low gamma voltage are alternately arranged for every row and column in the first and second directions.

14. The display apparatus of claim 1, wherein each of the plurality of pixels includes:

a plurality of first color pixels arranged in the first direction;

a plurality of second color pixels arranged in the first direction at a first side with respect to the plurality of first color pixels; and a plurality of third color pixels arranged in the first direction at the first side with respect to the plurality of second color pixels.

15. The display apparatus of claim 14, wherein the plurality of first color pixels include blue pixels, the plurality of second color pixels include green pixels, and the plurality of third color pixels include red pixels.

16. The display apparatus of claim 1, wherein the plurality of pixels are reversed in polarity for every two pixels in the first direction and for every six pixels in the second direction.

17. A method of driving a display apparatus that displays an image and includes N gate lines extending in a first direction, M data lines extending in a second direction substantially perpendicular to the first direction, and a plurality of pixels each of which is connected to a respective one of the N gate lines and a respective one of the M data lines, wherein N is a natural number greater than or equal to 48 and M is a natural number greater than or equal to 4, the method comprising:

sequentially driving K-th, (K+2)-th, (K+4)-th, (K+12)-th, (K+14)-th, (K+16)-th, (K+24)-th, . . . , (N−11)-th, (N−9)-th, and (N−7)-th gate lines during a first subframe period, wherein K is a natural number less than N;

sequentially driving (K+6)-th, (K+8)-th, (K+10)-th, (K+18)-th, (K+20)-th, (K+22)-th, (K+30)-th, . . . , (N−5)-th, (N−3)-th, and (N−1)-th gate lines during a second subframe period subsequent to the first subframe period;

sequentially driving (K+1)-th, (K+3)-th, (K+5)-th, (K+13)-th, (K+15)-th, (K+17)-th, (K+25)-th, . . . , (N−10)-th, (N−8)-th, and (N−6)-th gate lines during a third subframe period subsequent to the second subframe period;

sequentially driving (K+7)-th, (K+9)-th, (K+11)-th, (K+19)-th, (K+21)-th, (K+23)-th, (K+31)-th, . . . , (N−4)-th, (N−2)-th, and N-th gate lines during a fourth subframe period subsequent to the third subframe period; and driving the M data lines by outputting a plurality of data signals to the M data lines.

18. The method of claim 17, wherein driving the M data lines includes:

outputting first data signals having a first polarity during the first subframe period;

outputting second data signals having a second polarity opposite to the first polarity during the second subframe period;

outputting third data signals having the first polarity during the third subframe period; and outputting fourth data signals having the second polarity during the fourth subframe period.

19. The method of claim 18, wherein each of the plurality of data signals is generated using one of a high gamma voltage and a low gamma voltage, and the plurality of pixels has a gamma pattern in which a high gamma data voltage based on the high gamma voltage and a low gamma data voltage based on the low gamma voltage are alternately arranged for every row and column in the first and second directions.

* * * * *